US006809621B2

(12) United States Patent
Nagata et al.

(10) Patent No.: US 6,809,621 B2
(45) Date of Patent: Oct. 26, 2004

(54) INTERNAL COMBUSTION ENGINE IGNITION COIL, AND METHOD OF PRODUCING THE SAME

(75) Inventors: Takashi Nagata, Okazaki (JP); Kazutoyo Osuka, Gamagori (JP); Atsuyuki Konishi, Anjo (JP); Kazuhide Kawai, Kariya (JP); Junichi Wada, Aichi-pref (JP)

(73) Assignee: Denso Corporation, Kariya (JP)

( * ) Notice: Subject to any disclaimer, the term of this patent is extended or adjusted under 35 U.S.C. 154(b) by 105 days.

(21) Appl. No.: 10/343,157

(22) PCT Filed: May 30, 2002

(86) PCT No.: PCT/JP02/05310

§ 371 (c)(1),
(2), (4) Date: Jan. 29, 2003

(87) PCT Pub. No.: WO02/097831

PCT Pub. Date: Dec. 5, 2002

(65) Prior Publication Data

US 2003/0189476 A1 Oct. 9, 2003

(30) Foreign Application Priority Data

May 31, 2001 (JP) ..... 2001-165646
Oct. 18, 2001 (JP) ..... 2001-321038

(51) Int. Cl.[7] ..... H01F 27/02

(52) U.S. Cl. ..... 336/90; 336/92; 336/96; 29/602.1

(58) Field of Search ..... 336/90, 92, 96; 123/634, 635; 29/602.1, 606

(56) References Cited

U.S. PATENT DOCUMENTS 5,720,264 A 2/1998 Oosuka et al.
5,870,012 A * 2/1999 Sakamaki et al. ..... 336/107
6,208,231 B1 3/2001 Oosuka
6,215,385 B1 * 4/2001 Ogden ..... 336/96
6,457,229 B1 * 10/2002 Kanazawa et al. ..... 29/602.1
6,463,919 B1 * 10/2002 Skinner et al. ..... 123/634
6,469,608 B2 * 10/2002 Shimoide et al. ..... 336/90
6,700,470 B2 * 3/2004 Butler et al. ..... 336/96

FOREIGN PATENT DOCUMENTS

| | | |
|---|---|---|
| JP | 48-45543 | 6/1973 |
| JP | 8-339928 | 12/1996 |
| JP | 9-180947 | 7/1997 |
| JP | 10-289831 | 10/1998 |
| JP | 11-111545 | 4/1999 |
| JP | 2000-243638 | 9/2000 |
| JP | 2000-311824 | 11/2000 |
| JP | 2001-267121 | 9/2001 |
| WO | WO 00/75936 | 12/2000 |

* cited by examiner

*Primary Examiner*—Anh Mai
(74) *Attorney, Agent, or Firm*—Nixon & Vanderhye P.C.

(57) ABSTRACT

An ignition coil (1) having a case (2), a core (22) installed in the case, a primary spool (25) disposed substantially coaxially around an outer circumference of the core within the case, a primary coil (26) comprising a wire wound around the primary spool, a secondary spool (23) disposed substantially coaxially around the outer circumference of the core within the case, a secondary coil (24) comprising a wire wound around the secondary spool and a resin insulating material (5) filled within the case, the ignition coil being characterized in that the spool of the primary and the secondary spools which is disposed between the secondary coil and the core and/or which is disposed between the secondary coil and the primary coil comprises a base resin having an adhesive strength to the resin insulating material which is less than that provided by polybutylene terephthalate and an insulation breakdown voltage which exceeds that provided by polyphenylene sulfide.

39 Claims, 10 Drawing Sheets

INTERNAL COMBUSTION ENGINE IGNITION COIL, AND METHOD OF PRODUCING THE SAME

This application is the US national phase of international application PCT/JP02/05310 filed 30 May 2002 which designated the U.S.

TECHNICAL FIELD

The present invention relates to an ignition coil for generating a high voltage that is applied to spark plugs of an internal combustion engine and a method for fabricating the same ignition coil.

BACKGROUND OF THE INVENTION

An internal combustion engine ignition coil (hereinafter, simply referred to as an "ignition coil") is a device for generating a spark across a gap of a spark plug by producing a high voltage through mutual induction actions of coils. There are several types of ignition coils. For example, there is a stick-type ignition coil adapted to be installed in a plug hole and this stick-type ignition coil has a rod-like core, a cylindrical secondary spool disposed around the outer circumference of the core, a secondary coil wound around the secondary spool, a cylindrical primary spool disposed around the outer circumference of the secondary coil and a primary coil wound around the primary spool. Namely, the core, secondary spool, secondary coil, primary spool and primary coil are disposed coaxially in that order from the inner circumference of the ignition coil. These members are accommodated in a hollow cylindrical case. In addition, in order to secure electric insulation between the respective members and to allow the members to adhere to each other in the case, a resin insulating material is filled in the case.

In this respect, a base resin constituting, in particular, the spool of the primary and secondary spools which is disposed between the primary coil and the secondary coil (the primary spool in the aforesaid conventional example) has conventionally been required to have high electric insulation. This is because, in the case where a failure of insulation occurs to allow the secondary coil side, that is, the high-tension side and the primary coil side, that is, the low-tension side to electrically communicate with each other, there is a risk that a desired voltage cannot be secured on the secondary coil side.

In addition, the base resin constituting, in particular, the spool of the primary and secondary spools which is disposed between the primary coil and the secondary coil has conventionally been required to have a high adhesion to the resin insulating material. This is because the coefficient of linear expansion of the base resin of the spool is different from that of a wire constituting the coil which is wound around the spool, and, due to this, if the adhesion between the resin insulating material filled between the spool and the wire and the base resin of the spool is low, there is a risk that the spool and the resin insulating material may separate from each due to thermal stress. If the spool separates from the resin insulating material, a corona discharge is produced within a space formed by the separation, leading to a risk that electric insulation between the primary coil and the secondary coil cannot be secured.

Thus, the base resin constituting the spool has conventionally been required to be highly insulating and to have high adhesion to the resin insulating material.

In order to satisfy the aforesaid requirements, conventionally used for the base resin of the spool have been polyphenylene ether (PPE), polybutylene terephthalate (PBT), polyethylene terephthalate and the like which are highly insulating and have high adhesion to the resin insulating material.

However, when the spool is formed of a base resin which has a high adhesion to the resin insulating material, the following problems occur. Namely, as the coefficient of linear expansion of the base resin is different from that of the wire constituting the coil, if the ignition coil is used under a thermal cycling environment where the temperature is raised and lowered repeatedly, thermal stress is produced repeatedly in the spool due to the difference in coefficient of linear expansion. This thermal stress so produced can be relaxed only if the spool separates from the resin insulating material. However, the adhesion between the spool and the resin insulating material is made high in order to restrain the separation. Due to this, the thermal stress cannot be relaxed as desired, and there may be incurred the risk that cracks are produced in the spool. Then, if cracks are produced in the spool, the high-tension side and the low-tension side are allowed to electrically communicate with each other, leading to a risk that the desired voltage cannot be secured.

To cope with this, for example, with a conventional ignition coil disclosed in Japanese Unexamined Patent Publication (Kokai) No. 11-111545, as shown in FIGS. 9A, 9B, a separation tape 203 was wound between a spool 200 and a resin insulating material 202 filled on a wire 201 side. The generation of thermal stress attributed to the difference in coefficient of linear expansion between the spool 200 and the resin insulating material 202 in FIG. 9A and between the spools 200 and 206 and the wire 201 and resin insulating materials 202, 204 in FIG. 9B was restrained by separating the spool 200 from the resin insulating material 202 with the separation tape 203, whereby the generation of cracks in the spools 200 and 206 was restrained.

In addition, with the conventional ignition coil, in order to restrain the generation of cracks in the spools, a rubber component such as styrene ethylene butene styrene (SEBS) was added to a base resin for the spools. Then, the toughness of the spools was enhanced by the rubber component so added to thereby restrain the generation of cracks in the spools.

Thus, with the conventional ignition coil, in order to suppress the generation of cracks in the spool, a separation tape was wound around the spool or the rubber component was added in the spool, which served not only to increase the production costs of the ignition coil but also to complicate the production process.

Incidentally, the aforesaid problems are attributed to the high adhesion between the base resin constituting the spool and the resin insulating material. To cope with this, if a resin such as polyphenylene sulfide (PPS) introduced in Japanese Unexamined Patent Publication (Kokai) No. 8-339928, which has a low adhesion to the resin insulating material, is used as the base resin, the risk that cracks are produced in the spool will be reduced.

However, when compared with PPE, PBT, and PET, PPS has lower electric insulating properties. Due to this, if PPS is used as the base resin, due to the low adhesion inherent in PPS, there may be a risk that the resin insulating material separates from the spool, and if this occurs, there may be a risk that the insulation breakdown between the high-voltage side and the low-voltage side can be facilitated.

Namely, a slight gap existing between the resin insulating material and the spool may damage the insulation therebetween. Due to this, in the prior art, it was arranged for ignition coils to use, as a base resin for constituting a spool, a resin having a high adhesion to the resin insulating material so that, if unavoidable, there is formed, between the resin insulating material and the spool, as small a gap as possible.

As has been described heretofore, base resins for constituting the spool have conventionally been required to have the high electric insulation and high adhesion to the insulating resin. However, with the high adhesion, cracks are produced in the spool. In contrast, with the low adhesion, the spool and the resin insulating material are made to separate from each other easily.

The inventor of the invention studied the relationship between the combination of the adhesion of the base resin constituting the spool to the resin insulating material and the electric insulation of the base resin and the failure of insulation. As a result, the inventor determined that the failure of insulation can be prevented, without using the separation tape, by using as the base resin for the spool, a resin having a low adhesion to the resin insulating material and high electric insulation.

DISCLOSURE OF THE INVENTION

An ignition coil of the invention was completed based upon this knowledge. Consequently, an object of the invention is to provide an ignition coil having high electric insulation and which can be fabricated at reduced costs by obviating the necessity of a separation tape.

In addition, another object of the invention is to provide a method for fabricating the ignition coil of the invention relatively easily.

With a view to solving the problems, according to the invention, there is provided an ignition coil having a case, a rod-like core installed in the case, a cylindrical primary spool disposed substantially coaxially around an outer circumference of the core within the case, a primary coil comprising a wire wound around the primary spool, a cylindrical secondary spool disposed substantially coaxially around the outer circumference of the core within the case, a secondary coil comprising a wire wound around the secondary spool and a resin insulating material filled within the case, the ignition coil being characterized in that the spool of the primary and secondary spools which is disposed between the secondary coil and the core and/or which is disposed between the secondary coil and the primary coil comprises a base resin having an adhesive strength to the resin insulating material which is less than that provided by polybutylene terephthalate and an insulation breakdown voltage which exceeds that provided by polyphenylene sulfide.

In short, the ignition coil according to the invention is such that at least one of the primary and secondary spools is formed of the base resin having the adhesive strength which is less than that provided by PBT, as well as the insulation breakdown voltage which exceeds that provided by PPS.

Here, the adhesive strength to the resin insulating material is a parameter for evaluating the adhesion of the base resin to the resin insulating material. The higher the adhesive strength becomes, the higher the adhesive quality becomes. Note that the adhesive strength is measured using a measuring method shown in an embodiment which will be described later. In addition, the insulation breakdown voltage is a parameter for evaluating the electric insulation. The higher the insulation breakdown voltage becomes, the higher the electric insulation becomes. The insulation breakdown voltage is also measured using a measuring method shown in the embodiment which will be described later.

With the ignition coil according to the invention, the adhesive strength of the base resin constituting the spool to the resin insulating material is low. Due to this, there may be a risk that a separation is produced between the spool and the resin insulating material. However, even if the separation occurs, as the electric insulation of the base resin is high, there will be little chance that there is a risk that an insulation breakdown occurs between the high-voltage side and the low-voltage side.

In short, the ignition coil according to the invention is such that the spool and the resin insulating material are caused to separate from each other, as if it were intentional, by molding the spool itself from the base resin having the low adhesive strength to the resin insulating material to thereby restrain the production of cracks in the spool. Thus, with the ignition coil of the invention, even if the spool and the resin insulating material are caused to separate from each other, the insulation breakdown is prevented from occurring between the high-voltage side and the low-voltage side due to high electric insulation.

According to the ignition coil of the invention, a high electric insulation can be secured. In addition, according to the ignition coil of the invention, for example, a separation tape need not be wound around the spool nor does a rubber component need to be added into the base resin constituting the spool. Due to this, the construction of the ignition coil can be made simple and, therefore, the production costs can be reduced.

In addition, with a view to solving the problems, according to the invention, there is provided an ignition coil having a case, a rod-like core installed in the case, a cylindrical primary spool disposed substantially coaxially around an outer circumference of the core within the case, a primary coil comprising a wire wound around the primary spool, a cylindrical secondary spool disposed substantially coaxially around the outer circumference of the core within the case, a secondary coil comprising a wire wound around the secondary spool and a resin insulating material filled within the case, the ignition coil being characterized in that the spool of the primary and secondary spools which is disposed between the secondary coil and the core and/or which is disposed between the secondary coil and the primary coil comprises a base resin having an adhesive strength to the resin insulating material which is less than that provided by polyethylene terephthalate and an insulation breakdown voltage which exceeds that provided by polyphenylene sulfide.

In short, the ignition coil according to the invention is such that at least one of the primary and secondary spools is formed of the base resin having the adhesive strength which is less than that provided by PET, as well as the insulation breakdown voltage which exceeds that provided by PPS.

With the ignition coil according to the invention, the adhesive strength of the base resin constituting the spool to the resin insulating material is low. Due to this, there may be a risk that separation is produced between the spool and the resin insulating material. However, even if the separation occurs, as the electric insulation of the base resin is high, there will be little chance of a risk that an insulation breakdown occurs between the high-voltage side and the low-voltage side.

In short, the ignition coil according to the invention is such that the spool and the resin insulating material are caused to separate from each other, as if it were intentional, by molding the spool itself from the base resin having the low adhesive strength to the resin insulating material to thereby restrain the production of cracks in the spool. Thus, with the ignition coil of the invention, even if the spool and the resin insulating material are caused to separate from each other, the insulation breakdown is prevented from occurring between the high-voltage side and the low-voltage side due to high electric insulation.

According to the ignition coil of the invention, high electric insulation can be secured. In addition, according to the ignition coil of the invention, for example, separation tape need not be wound around the spool nor does a rubber component need to be added into the base resin constituting the spool. Due to this, the construction of the ignition coil can be made simple, and therefore, the production costs can be reduced.

Preferably, the base resin is a syndiotactic polystyrene. The adhesive strength of the syndiotactic polystyrene is less than that provided by PBT and hence is very low. Additionally, the insulation breakdown voltage of the syndiotactic polystyrene exceeds that provided by PPS and hence is very high. Due to this, in a case where the spool is formed of the syndiotactic polystyrene, even if the spool separates from the resin insulating material, there is little chance of a risk that the insulation between the high-voltage side and the low-voltage side is broken down. In addition, the syndiotactic polystyrene provides a high fluidity when it is molten during injection molding. From this viewpoint, the syndiotactic polystyrene is preferable as a base resin for constituting the spool.

The ignition coil according to the invention preferably embodies a stick-type ignition coil which is installed in a plug hole in a cylinder.

The ignition coil according to the invention can maintain high electric insulation for a long time even in a severe thermal-cycling environment. Additionally, according to the ignition coil of the invention, a separation tape need not be wound around the spool. This can facilitate making the ignition coil smaller in outside diameter. Consequently, the ignition coil according to the invention is suitable for a stick-type ignition coil that is subjected to severe changes in temperature and which needs to be made smaller in outside diameter.

In addition, with a view to solving the problems, according to the invention, there is provided an ignition coil having a case, a rod-like core installed in the case, a cylindrical primary spool disposed substantially coaxially around an outer circumference of the core within the case, a primary coil comprising a wire wound around the primary spool, a cylindrical secondary spool disposed substantially coaxially around the outer circumference of the core within the case, a secondary coil comprising a wire wound around the secondary spool and a resin insulating material filled within the case, the ignition coil being characterized in that the primary and secondary spools which are disposed between the secondary coil and the core and disposed between said secondary coil and said primary coil comprise a base resin which can hold electric insulation even if a high voltage is produced in the secondary coil in association with the generation of a separation between the resin insulating material and the spool.

With the base resin of the ignition coil according to the invention, even if there occurs a separation between the resin insulating material and the spool, the insulation between the secondary coil side and the primary coil side can be ensured. In other words, even if there occurs a separation, there is little chance that the insulation between the high-voltage side and the low-voltage side is broken down.

Preferably, the syndiotactic polystyrene is an improved syndiotactic polystyrene whose coefficient of linear expansion can be adjusted, and the coefficient of linear expansion of an end portion of the spool comprising the improved syndiotactic polystyrene is 135% or less, assuming that the coefficient of linear expansion of the resin insulating material is 100%.

The reason why the coefficient of linear expansion is set equal to or less than 135% is because, as will be described later, if the coefficient of linear expansion of the end portion of the spool exceeds 135%, the expansion of the end portion becomes much larger than the expansion of the resin insulating material. It is also because of a concern that there may be caused a defect in the resin insulating material and/or the spool.

Preferably, the improved syndiotactic polystyrene is formed by adding reinforced fibers into a syndiotactic polystyrene, and the reinforced fibers are oriented at random or circumferentially at the end portion of the spool.

When the reinforced fibers are dispersed at random or circumferentially, the coefficient of linear expansion of the end portion of the spool can be reduced. This makes it possible to reduce the difference in expansion between the resin insulating material and the end portion. Consequently, according to the construction, the risk is reduced that a defect is caused in the resin insulating material and/or the spool.

Preferably, the reinforced fibers are glass fibers and the resin insulating material is an epoxy resin. If the combination of the reinforced fibers and the resin insulating material is limited to the aforesaid combination, it is ensured that the difference in expansion between the resin insulating material and the end portion can be reduced.

Additionally, with a view to solving the problems, according to the invention, there is provided a method for fabricating an ignition coil having a spool comprising a winding portion around which a wire is wound and end portions disposed at longitudinal ends of the winding portion, the method comprising a spool material preparing process for preparing a spool material by adding reinforced fibers into a molten resin, a spool member molding process for injecting the spool material into a cavity in a mold from a gate disposed at a position which confronts an end portion molding part of the cavity, cooling the spool material so injected so that the spool material sets in the cavity, and molding a spool member in which the reinforced fibers are oriented at random or circumferentially at the end portion, and a gate cutting process for cutting a portion of the spool member which corresponds to the gate.

In short, the ignition coil fabricating method according to the invention is such as to have the spool material preparing process, the spool member molding process and the gate cutting process. Among these processes, in the spool material preparing process, the reinforced fibers are added to and dispersed in the molten resin. Then, the spool material constituting the raw material of the spool is prepared. In addition, in the spool member molding process, the reinforced fibers constitute the spool member in which the reinforced fibers are oriented at random or circumferentially at the end portions thereof. Furthermore, in the gate cutting process, the gate corresponding portions which are linked with the end portion of the spool are cut. The spool so obtained is then disposed within the case together with the other members, and the resin insulating material is then filled in the case, whereby the ignition coil of the invention is completed. According to the fabrication method of the invention, the ignition coil having the spool in which the reinforced fibers are oriented can be fabricated relatively easily.

Preferably, the gate is a ring gate or a film gate. According to the construction, the reinforce fibers can be oriented more easily. Consequently, the ignition coil of the invention can be fabricated more easily. However, the ignition coil of the invention in which the reinforced fibers are oriented can be fabricated not only by the aforesaid fabrication method according to the invention but also by other known fabrication methods.

Additionally, with a view to solving the problems, according to the invention, there is provided an ignition coil having a case, a rod-like core installed in the case, a cylindrical primary spool disposed substantially coaxially around an outer circumference of the core within the case and having a winding portion around which a winding is wound, a cylindrical secondary spool disposed substantially coaxially around the outer circumference of the core within the case and having a winding portion around which a winding is wound, and a resin insulating material filled and set within the case, the ignition coil being characterized in that at least one of the primary and secondary spools is an SPS spool comprising a syndiotactic polystyrene as a base resin.

In short, in the ignition coil according to the invention, at least one of the primary and secondary spools is an SPS spool. As has been described above, the adhesive strength of the syndiotactic polystyrene to the resin insulating material is very low. Consequently, according to the ignition coil of the invention, the thermal stress attributed to the coefficient of linear expansion can be relaxed. In addition, if one of the spools is made to be a SPS spool, the thermal stress of the SPS spool can be relaxed, whereby the thermal stress of the other spool which is attributed to the thermal stress of the one spool can also be relaxed. Furthermore, the electric insulation of the syndiotactic polystyrene is very high. Consequently, according to the ignition coil of the invention, even if the SPS spool separates from the resin insulating material, the risk is low that the insulation between the high-voltage side and the low-voltage side is broken down. Thus, according to the ignition coil of the invention, the high thermal stress relaxation and high electric insulation can be provided at the same time.

Preferably, the primary spool is the SPS spool. The voltage of the winding wound around the primary spool is lower than the voltage of the winding wound around the secondary spool. Due to this, by using the SPS spool for the primary spool rather than the secondary spool the risk can be reduced that a failure such as an insulation breakdown is caused, for example, in the spool situated adjacent to the separation space by the separation of the SPS spool from the resin insulating material. Consequently, the ignition coil constructed according to the invention can provide a high reliability against a failure such as the insulation breakdown.

Preferably, the adhesive strength of the base resin to the resin insulating material is less than 15 MPa.

Below is a reason for setting the adhesive strength less than 15 MPa. An FEM analysis (an analyzing software, Design Space available from Cybernet System Co., Ltd.) was carried out as to a thermal stress (tensile stress) which acts on the spool by the contraction of the resin insulating material when there occurs no separation between the spool and the resin insulating material. The result of the analysis showed that a tensile force that acted on the spool was 24 MPa.

Consequently, in case the adhesive strength is set less than 24 MPa, the SPS spool can be separated from the resin insulating material. However, variations in dimensions of the respective members constituting the ignition coil and variations and changes in material properties of the respective members have to be taken into consideration. Even with the adhesive strength being less than 24 MPa, there may be incurred the risk that a defect such as a crack is generated in the SPS spool depending upon the variations. Furthermore, there may be incurred the risk that a defect is caused in the other spool. For these reasons, the adhesive strength of the base resin to the resin insulating material was set less than 15 MPa to secure a safety margin relative to 24 MPa.

Preferably, a gap is formed between the winding portion of the SPS spool and the resin insulating material that has penetrated and set between turns of the winding wound around the winding portion, and wherein the gap is formed in such a manner as to extend over 70% or more of the surface area of the winding portion. Assuming that the total surface area of the winding portion is 100%, the gap is formed to extend over 70% or more of the total surface area. The reason why the gap is formed to extend over 70% or more of the surface area of the winding portion is because, if the gap extends over less than 70% of the surface area of the winding portion, a difference in linear expansion coefficients of the respective members constituting the ignition coil makes it easier for the thermal stress to be transmitted to the SPS spool. Then, there may be incurred the risk that a defect such as a crack is generated in the SPS spool, as well as the other spool. Note that when used in this invention, the winding portion denotes a portion of the spool which has a coil on the outer circumferential surface thereof, as shown in FIG. 4 which will be described later.

Preferably, the gap is formed in such a manner as to extend over 90% or more of the surface area of the winding portion. According to the construction, the risk is diminished that a defect such as a crack is generated in the spool, as well as the other spool, even if the vehicle is used in a severe thermal environment such as is seen when the vehicle is used in a severely cold or hot area, the vehicle is driven to climb up slopes, the vehicle is driven with the accelerator pedal being fully depressed such in racing, or the vehicle is used for a long period of time. Namely, the ignition coil according to the invention has a high durability relative to the thermal environment.

Preferably, a gap is formed between the winding portion of the SPS spool and the resin insulating material that has penetrated and set between turns of the winding wound around the winding portion, and wherein the radial width of the gap is 0.01 mm or greater. The reason why the radial width of the gap is made 0.01 mm or greater is because with the radial width of the gap being less than 0.01 mm, a gap is substantially not formed, and consequently, the thermal stress is easily transmitted to the spool, as well as to the other spool.

Preferably, the radial width of the gap is less than 0.3 mm. Below is a reason for setting the radial width of the gap less than 0.3 mm. Namely, in a case where the SPS spool is disposed radially outwardly of the other spool, the gap is interposed between a coil (for example, the primary coil) constituted by a winding wound around the SPS spool and a coil (for example, the secondary coil) constituted by a winding wound around the other spool. Due to this, if the radial width of the gap is large, the insulation distance between the primary and secondary coils becomes shorter substantially to such an extent that the radial width is increased. The radial width of the gap is set less than 0.3 mm from this reason.

Preferably, the radial width of the gap is 0.01 mm or greater and the gap is formed in such a manner as to extend over 70% or more of the surface area of the winding portion. According to the construction, the thermal stress transmitted from the resin insulating material to the SPS spool can be relaxed in a more ensured fashion.

Preferably, the radial width of the gap is 0.01 mm or greater and the gap is formed in such a manner as to extend over 90% or more of the surface area of the winding portion. According to the construction, the thermal stress transmitted from the resin insulating material to the SPS spool and the thermal stress transmitted to the other spool can be relaxed in a more ensured fashion.

Preferably, the insulation breakdown voltage of the base resin is 15 kV/mm or greater when measured using a measuring method of JIS (Japanese Industry Standard) K 6911. According to the construction, the insulation breakdown voltage of the syndiotactic polystyrene is set to 15 kV/mm or greater.

Below is the reason why the insulation breakdown voltage is set 15 kV/mm or greater. An FEM analysis (an analyzing software, Design Space available from Cybernet System Co., Ltd.) was carried out as to a field strength that is generated in the spool. The result of the analysis showed that a field strength generated in the spool was 14.5 kV.

Consequently, in case the insulation breakdown voltage is set 14.5 kV or greater, the insulation can be ensured. However, variations in dimensions of the respective members constituting the ignition coil and variations and changes in material properties of the respective members have to be taken into consideration. From these reasons, the insulation breakdown voltage of the base resin was set 15 kV or greater in order to secure a certain safety margin relative to 14.5 kV.

With the insulation breakdown voltage being 15 vK or greater, the outside diameter of the ignition coil can be reduced with no insulation breakdown being generated in the base resin even if the ignition coil is used in an environment where a relatively high voltage is applied to the base resin. For example, an ignition coil can be obtained which can apply a high voltage of 30 kV to a spark plug when inserted in a plug hole.

Preferably, the case is formed from a high-adhesion resin having a higher adhesion to the resin insulating material than to the base resin. The high-adhesion resin forming the case has the higher adhesion to the resin insulating material than to the base resin. Consequently, the resin insulating material is drawn toward interior surfaces of the case within the case. Due to this, according to the construction, the separation of the resin insulating material from the SPS spool can be facilitated further. Consequently, a gap can be easily formed between the resin insulating material and the SPS spool.

In addition, with a view to solving the problems, according to the invention, there is provided an ignition coil having a case, a rod-like core installed in said case, a cylindrical primary spool disposed substantially coaxially around an outer circumference of the core within the case and having a winding portion around which a winding is wound, a cylindrical secondary spool disposed substantially coaxially around the outer circumference of the core within the case and having a winding portion around which a winding is wound, and a resin insulating material filled and set within said case, the ignition coil being characterized in that a gap is formed between the winding portion possessed by at least one of the primary and secondary spools and the resin insulating material that has penetrated and set between turns of the winding wound around the winding portion after the resin insulating material has set.

In the ignition coil according to the invention, the gap is formed between the winding portion possessed by at least one of the primary and secondary spools and the resin insulating material that has penetrated and set between turns of the winding wound around the winding portion. According to the ignition coil of the invention, a thermal stress applied to the spool from the thermosetting resin can be cut off by the gap. This can restrain the occurrence of a risk that a defect such as a crack is generated in the spool.

Preferably, the spool situated adjacent to the gap is the primary spool. The voltage of the winding wound around the primary spool is lower than that of the winding wound around the secondary spool. Due to this, by disposing the primary spool rather than the secondary spool adjacent to the gap, for example, a risk that a defect such as an insulation breakdown is caused in the spool disposed adjacent to the gap can be reduced by the gap. Consequently, the ignition coil according to the invention is highly reliable against a defect such as insulation breakdown.

Preferably, a base resin composing the spool situated adjacent to the gap is a syndiotactic polystyrene. As has been described before, the insulation breakdown voltage of syndiotactic polystyrene is very high. Consequently, according to the ignition coil constructed as has been described above, irrespective of the formation of the gap, the risk is low that the insulation between the high-voltage side and the low-voltage side is broken down. Therefore, the ignition coil constructed according to the invention can provide a high thermal stress relaxing quality, as well as a high electric insulation quality.

Preferably, the gap is formed in such a manner as to extend over 70% or more of the surface area of the winding portion. The reason why the gap is formed so as to extend over 70% or more of the surface area of the winding portion is, as has been described above, because in case the gap is formed so as to extend over less than 70% of the surface area of the winding portion, a difference in linear thermal expansion coefficient between the respective members constituting the ignition coil facilitates the transmission of the thermal stress to the SPS spool. In addition, this is because there may be incurred the risk that a defect such as a crack is generated in the SPS spool, as well as the other spool.

Preferably, the gap is formed in such a manner as to extend over 90% or more of the surface area of the winding portion. As has been described above, according to the construction, even if the vehicle is used in the thermally severe environment, a risk that a defect such as a crack is generated in the spool can be maintained low. Namely, the ignition coil constructed according to the invention is highly durable against a thermal environment.

Preferably, the radial width of the gap is 0.01 mm or greater. As has been described above, the reason why the radial width of the gap is made 0.01 mm or greater is because, with the radial width of the gap being less than 0.01 mm, a gap is substantially not formed, this facilitating the transmission of the thermal stress to the spool.

Preferably, the radial width of said gap is less than 0.3 mm. Below is the reason why the radial width of the gap is made less than 0.3 mm. Namely, as has been described above, in a case where the spool disposed adjacent to the gap is disposed radially outwardly of the other spool, in case the radial width of the gap is large, the insulation distance between the primary and secondary coils becomes substantially shorter to such an extent that the radial width is increased.

Preferably, the radial width of the gap is 0.01 mm or greater and the gap is formed in such a manner as to extend over 70% or more of the surface area of the winding portion.

This construction ensures further that the thermal stress transmitted from the resin insulating material to the spool disposed adjacent to the gap can be relaxed.

Preferably, the radial width of the gap is 0.01 mm or greater and the gap is formed in such a manner as to extend over 90% or more of the surface area of the winding portion. This construction further ensures that the thermal stress transmitted from the resin insulating material to the spool disposed adjacent to the gap can be relaxed.

Preferably, the insulation breakdown voltage of the base resin composing the spool situated adjacent to the gap is 15 kV/mm or greater when measured using the measuring method of JIS K 6911. According to the construction, the insulation breakdown voltage of the base resin is set to 15 kV/mm or greater.

As has been described above, the reason why the insulation breakdown voltage is set 15 kV/mm or greater is because the safety margin is secured relative to the field strength of 14.5 kV obtained the FEM analysis. In a case where the insulation breakdown voltage is 15 kV or greater, the outside diameter of the ignition coil can be reduced with no insulation breakdown being generated in the base resin even if the ignition coil is used in an environment where a relatively high voltage is applied to the base resin. For example, an ignition coil can be obtained which can apply a high voltage of 30 kV to a spark plug when inserted in a plug hole.

Preferably, the insulation breakdown voltage of the base resin composing the spool situated adjacent to the gap is 15 kV/mm or greater when measured using a measuring method for actually measuring the spool itself. The method for measuring an insulation breakdown voltage by the aforesaid JIS K 6911 is a method for measuring an insulation breakdown voltage by applying a voltage to a test piece. In contrast, the method for measuring an insulation breakdown voltage according to the invention is a method for directly measuring the insulation breakdown voltage of the spool itself.

A conceptual measuring method constructed according to the invention is shown in FIG. 10. A rod-like electrode 501 which is grounded is inserted in a cylindrical spool 500. In addition, another electrode 502 is disposed on an outer circumferential surface of the spool 500. Namely, a cylindrical wall of the spool 500 is held by the two electrodes 501, 502. The voltage applied to the two electrodes 501, 502 is gradually increased, and a voltage at which an electrical communication is established between the electrodes 501, 502 is the insulation breakdown voltage of the invention. According to the construction of the invention, the insulation breakdown voltage can easily be measured without preparing a test piece separately. Here, the reason why the insulation breakdown voltage is set 15 kV/mm or greater is because, as has been described above, the safety margin is secured relative to the field strength of 14.5 kV which was obtained by the FEM analysis.

Preferably, the adhesive strength of the base resin composing the spool situated adjacent to the gap to the resin insulating material is less than 15 MPa. Here, the reason why the adhesive strength is set less than 15 MPa is because, as has been described above, the safety margin is secured relative to the tensile stress of 24 MPa which was obtained by the FEM analysis.

Furthermore, with a view to solving the problems, according to the invention, there is provided a method for fabricating an ignition coil having a case, a rod-like core disposed in said case, a cylindrical inner spool disposed substantially coaxially around an outer circumference of the core within the case and having a winding portion around which a winding is wound, a cylindrical outer spool disposed substantially coaxially around the outer circumference of the core within the case, possessing a winding portion around which a winding is wound and having an outer circumferential surface having a lower adhesion to a resin insulating material than to an inner circumferential surface of the case, and the resin insulating material filled and set within the case, the method comprising an insulating material filling process for filling the resin which is something like a liquid into the case in which the respective members are disposed, an insulating material gelling process for gelling the resin insulating material so filled at a high temperature, and an insulating material cooling process for cooling the resin insulating material so gelled together with the case and the outer spool.

In other words, the ignition coil fabricating method according to the invention is such as to have the insulation material filling process, the insulation material gelling process and the insulation material cooling process. Among the processes, in the insulation material filling process, the members such as the primary spool and the secondary spool are first disposed within the case, and next, the liquid-like resin insulation material is filled within the case. In the insulation material gelling process, the resin insulation material is held for a predetermined period of time at the setting temperature so that the resin insulation material is gelled. In the insulation material cooling process, the thermosetting resin in which a setting reaction is completed is cooled. The resin insulation material is separated from the outer circumferential surface of the outer spool during the cooling of the thermosetting resin because the adhesion between the outer circumferential surface of the outer spool and the resin insulation material is lower than the adhesion between the inner circumferential surface of the case and the resin insulation material. When the thermosetting resin is filled through the processes the gap is formed between the winding portion possessed by at least one of the primary and secondary spools and the resin insulation material that penetrates between turns of the winding wound around the winding portion for setting thereat. Namely, the ignition coil according to the invention can be fabricated by the ignition coil fabricating method according to the invention.

In addition, the fabricating method according to the invention is such as to form the gap by making use of the total contraction of the resin insulation material. A typical volume change happening during the setting process of the thermosetting resin is shown in FIG. 11. In the figure, the axis of abscissa represents temperatures. In the figure the axis of ordinates represents volumes. As shown in the figure, firstly, the volume of the liquid-like thermosetting resin increases due to the simple thermal expansion of the liquid happening as it is heated from point A to point B (to the setting temperature). Next, from point B to point C, the thermosetting resin is held at the thermosetting temperature for the predetermined period of time. As this happens, the thermosetting resin is transformed from a liquid to a gelled state through the thermal reaction. Then, the volume of the thermosetting resin decreases. Finally, from point C to point D, the thermosetting resin in which the thermal reaction is completed is cooled down to the room temperature. As this occurs, the volume of the thermosetting resin decreases further. As a result, the volume at point D becomes smaller than the volume at point A. This is referred to as the total contraction.

According to the fabricating method of the invention, the ignition coil of the invention can be fabricated relatively easily by making use of the total contraction. The ignition coil of the invention can, however, be fabricated by not only the fabricating method of the invention but also known fabricating methods.

The invention can be understood more sufficiently from the following description of preferred embodiments of the invention while referring to the accompanying drawings.

BEST MODE FOR CARRYING OUT THE INVENTION

Embodiments of the invention will be described based upon the accompanying drawings.

(First Embodiment)

Figure 1:
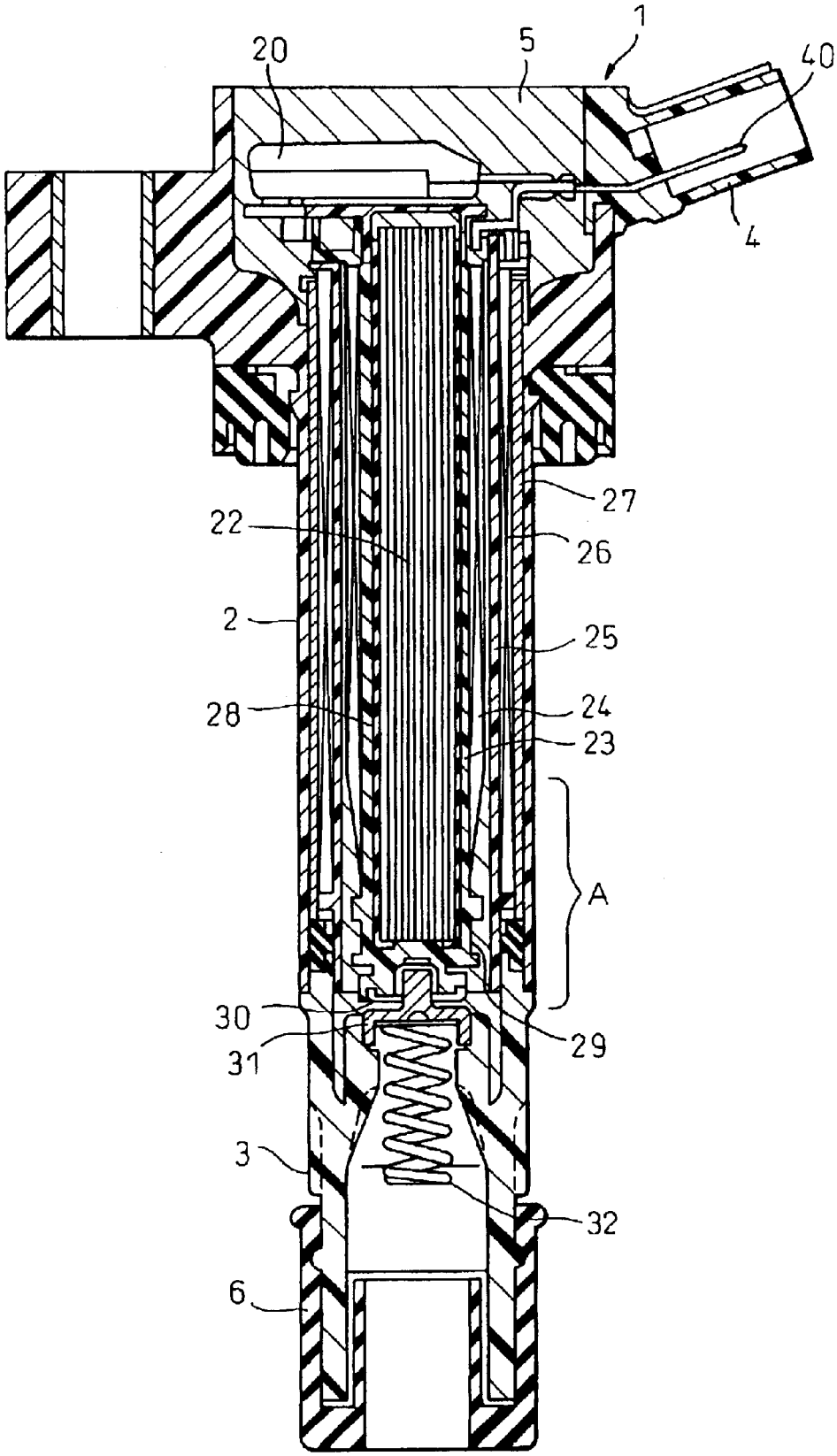
FIG. 1 is an axial sectional view of an ignition coil according to a first embodiment of the invention.

Firstly, the construction of an ignition coil 1 according to a first embodiment will be described. An axial sectional view of the ignition coil 1 according to the embodiment is shown in FIG. 1. The ignition coil 1 is a so-called stick-type ignition coil and is disposed in a plug hole in an upper portion of an engine block, not shown, for each cylinder. As shown in the figure, an outer shell of the ignition coil 1 comprises a case 2 and a high-voltage tower 3. The case 2 is made from resin and exhibits a cylindrical shape. The high-voltage tower 3 is also made from resin and exhibits a cylindrical shape. The high-voltage tower 3 is fixed to a lower end of the case 2.

Accommodated in the case are a core 22, a secondary spool 23, a secondary coil 24, a primary spool 25, a primary coil 26, an outer core 27 and a rubber tube 28.

The core 22 exhibits a rod-like shape and is disposed on a central axis of the cylindrical case 2. The core 22 is formed by laminating silicone steel plates in a radial direction.

The rubber tube 28 is disposed so as to cover an outer circumferential surface of the core 22. The rubber tube 28 has a role as an insulation material.

The secondary spool 23 is disposed on an outer circumferential side of the rubber tube 28. The secondary spool 23 is made from resin and exhibits a bottomed cylindrical shape. In addition, the secondary coil 24 is disposed on an outer circumferential surface of the secondary spool 23. The secondary coil 24 comprises a wire wound and laminated around the secondary spool 23.

The primary spool 25 is disposed on an outer circumferential side of the secondary coil 24. Here, a base resin composing the primary spool 25 is syndiotactic polystyrene. As with the secondary spool 23, the primary spool 25 also exhibits a bottomed cylindrical shape. Additionally, the primary coil 26 is disposed on an outer circumferential surface of the primary spool 25. The primary coil 26 comprises a wire wound and laminated around the primary spool 25.

A dummy coil 29 is connected below the secondary coil 24. The dummy coil 29 is also formed by winding a wire. The dummy coil 29 electrically connects the secondary coil 24 with a terminal plate 30., Then, the two members are electrically connected not by a single wire but by the dummy coil 29, which increases the surface area of an electric connecting portion between the two members, whereby electrostatic focus to the electric connecting portion is avoided.

The outer core 27 is disposed on the outside of the primary coil 26. The outer core 27 is formed by winding a thin silicone steel plate cylindrically. The outer core 27 restrains the leakage of magnetic line of force to the outside of the ignition coil 1. Note that a winding initiating end and a winding terminating end of the outer core 27 are not connected to each other. Consequently, an axially extending slit is formed between the winding initiating end and the winding terminating end.

A connector 4 is disposed in such a manner as to protrude from an upper end of the case 2 in a radial and upwardly inclined direction. A terminal 40 is connected to the connector 4 through an insert molding. The terminal 40 is electrically connected to an igniter 20 disposed at an upper portion of the case 2. The igniter 20 functions to switch a primary current that is supplied to the primary coil 26. A resin insulation material 5 comprising epoxy resin is filled in the interior of the case 2. Then, the resin insulation material 5 so filled ensures insulation between the respective members which are disposed close to each other.

On the other hand, placed in the interior of the high-voltage tower 3 are the terminal plate 30, a high-volatage terminal 31 and a spring 32.

The terminal plate 30 exhibits a disk-like shape. A plate-like pawl portion which is bent upwardly is disposed at the center of the terminal plate 30. The high-voltage terminal 31 exhibits a disk-like shape having a raised portion at the center of an upper surface thereof or a shape something like a lid of a pan. Then, the raised portion of the high-voltage terminal 31 is inserted into the pawl portion of the terminal plate 30. On the other hand, a lower portion of the high-voltage terminal 31 exhibits a cup-like shape. Then, an upper end of the spring 32 which is connected to a spark plug (not shown) is inserted into the cup-like lower portion of the high-voltage terminal 31. A rubber cylindrical plug cap 6 is placed on a lower end of the high-voltage tower 3. The spark plug is press fitted in this plug cap 6.

Next, the flow of current in the ignition coil 1 of the embodiment will be described. In a primary or a low-voltage side, a primary current flows through the terminal 40, the igniter 20 and the primary coil 26 in that order. When the primary current is switched by the igniter 20, a high voltage is generated on a secondary side by virtue of mutual induction action. A spark is generated in a gap of the spark plug by the high voltage so generated. Namely, on the secondary or high-voltage side, a secondary current flows through the secondary coil 24, the dummy coil 29, the terminal plate 30, the high-tension terminal 31, the spring 32 and the spark plug in that order.

Next, the characteristics and advantages of the ignition coil 1 of the embodiment will be described. In the first embodiment, the base resin of the primary spool 25 which is disposed between the primary coil 26 and the secondary coil 24 is syndiotactic polystyrene (SPS). The SPS has a construction in which side chains are coordinated in opposite directions alternately relative to a main chain, this construction being different from the construction of a conventional non-syndiotactic polystyrene (PS). The adhesive strength of the SPS to the resin insulation material is very low and less than that provided by PBT due to this construction. In addition, the insulation breakdown voltage of the SPS exceeds that of the PS and is very high. Since the SPS is the base resin of the primary spool 25, the primary spool 25 of the ignition coil 1 of the embodiment easily separates from the resin insulation material 5 filled on the primary coil 26 side. A thermal stress applied from the resin insulation material 5 to the primary spool 25 can be reduced. Consequently, the risk is diminished that a crack is generated in the primary spool 25 and also in the secondary spool 23 that would otherwise occur due to the thermal stress that would otherwise be transmitted to the primary spool 25. In addition, the primary spool 25 has a high electric insulation quality. Due to this, even if the primary spool 25 separates from the resin insulation material 5, the risk is diminished that the insulation between the high-voltage side and the low-voltage side is broken.

In addition, the SPS can provide a high fluidity when the spool is formed or injection molded from the SPS which is in a molten state. Judging from this, too, the SPS is preferable as a base resin for the spool of the ignition coil of the invention.

In addition, when looking closely at the ignition coil according to the first embodiment, a gap is formed between the resin that has penetrated into the primary coil and the primary spool.

Figure 2A:
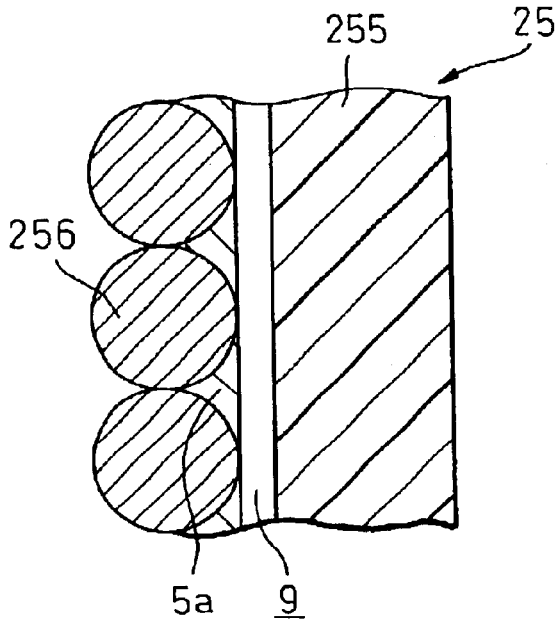
FIGS. 2A and 2B are enlarged sectional views showing portions in the vicinity of a winding portion of a primary spool of the ignition coil according to the first embodiment, respectively.
Figure 2B:
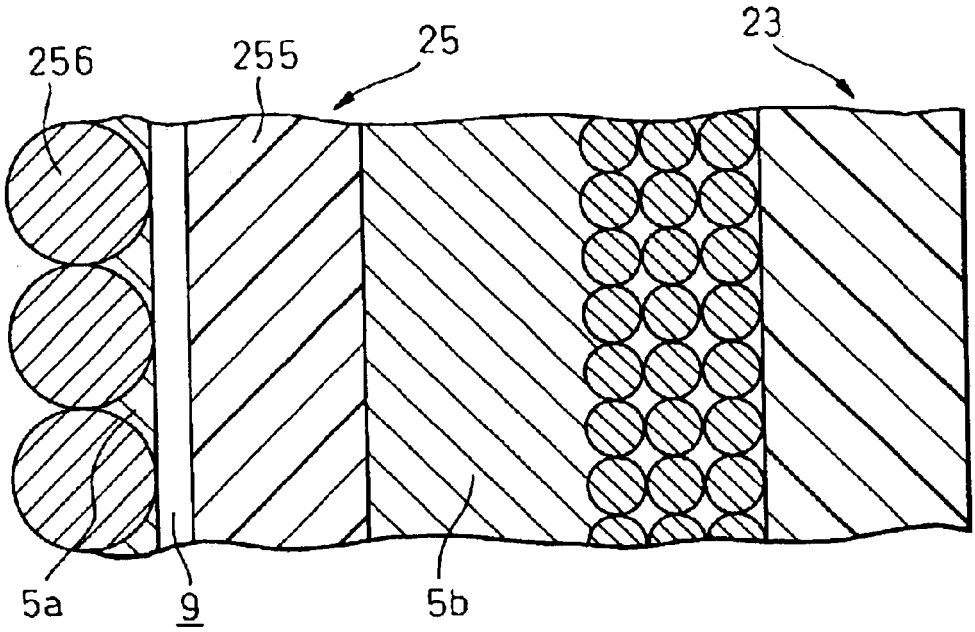

Enlarged sectional views are shown in FIGS. 2A, 2B which show, respectively, portions in the vicinity of a winding portion 255 of the primary spool 25 of the ignition coil of the invention. As shown in the figures, the resin insulation material 5*a* penetrates and sets between turns of a winding 256. A gap 9 is formed between an inner circumferential surface of the resin insulation material 5*a* and an outer circumferential surface of the winding portion 255. The gap 9 is formed in such a manner as to extend over 95% of the surface area of the winding portion 255. In addition, the radial width of the gap 9 is 0.15 mm.

In addition, in the ignition coil of the embodiment, the adhesion to the resin insulation material 5 of the base resin which makes up the primary spool 25 is lower than the adhesion to the resin insulation material 5 of the material of the outer core 27 which is part of the case. To be specific, the outer core 27 is a silicone steel plate, and the base resin composing the primary spool 25 is sydiotactic polystyrene.

Figure 3:
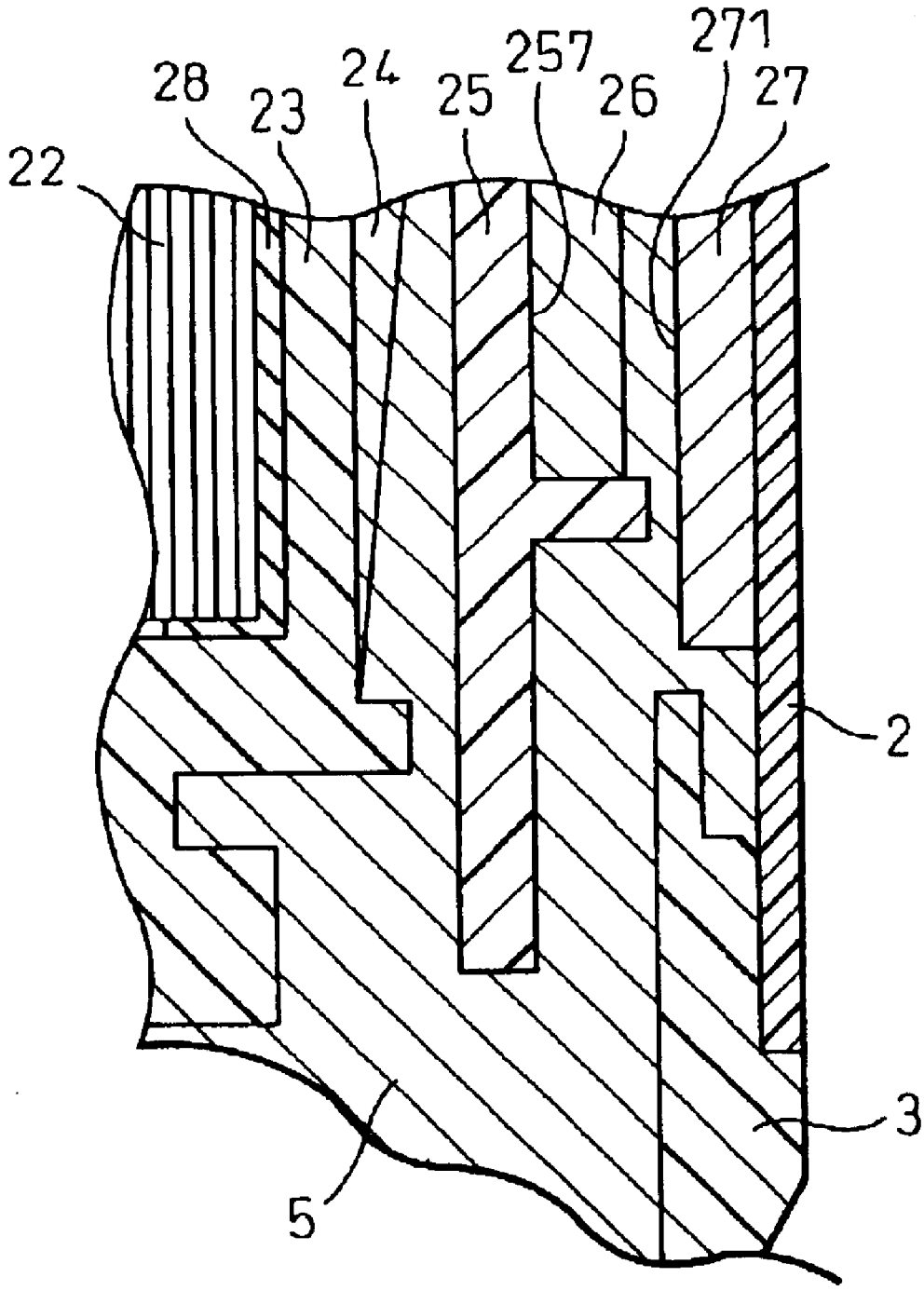
FIG. 3 is an enlarged sectional view showing a portion in the vicinity of an end portion of the primary spool of the ignition coil according to the first embodiment.
Figure 11:
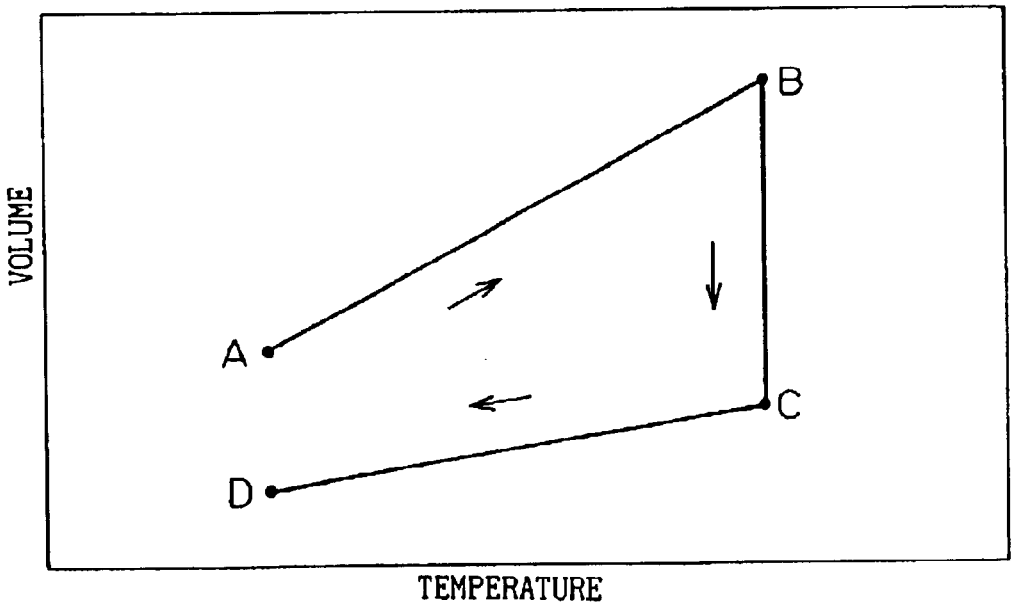
FIG. 11 is a chart showing a typical volume change in a setting process of a thermosetting resin.

The ignition coil of the embodiment was fabricated using a fabricating method comprising the aforesaid insulation material filling process, a insulation material gelling process and an insulation material cooling process. The setting temperature of the resin insulation material at the time of fabricating was set to 120° C. (refer to FIG. 11). An enlarged sectional view is shown in FIG. 3 which shows a portion in the vicinity of an end portion (corresponding to a portion A in FIG. 1) of the primary spool of the ignition coil of the embodiment. With this fabricating method being adopted, as shown in the figure, as the adhesion of an outer circumferential surface 257 of the primary spool 25 to the resin insulation material 5 is lower than the adhesion of an inner circumferential surface 271 of the outer core 27 to the resin insulation material 5, the gap can be formed between the resin insulation material 25 and the outer circumferential surface 257 of the primary spool 25.

As shown in FIG. 2A, according to the ignition coil of the embodiment, the primary spool 25 and the resin insulation material 5*a* are separated from each other by the gap 9. Due to this, a thermal stress attributed to a difference in linear expansion coefficient between the primary spool 25 and the resin insulation material 5*a* can be relaxed. In addition, as shown in FIG. 2B, a thermal stress attributed to a difference in linear expansion coefficient between the primary spool 25 and secondary spool 23 and the winding 256 and resin insulation materials 5*a*, 5*b* can be relaxed.

Additionally, according to the ignition coil of the invention, the gap is formed in such a manner as to extend over 95% of the surface area of the winding portion 255. Due to this, the risk is diminished that a defect such as a crack is generated not only in the primary spool 25 but also in the secondary spool 23, even if the vehicle is used in a severe thermal environment such as when the vehicle is used in a severely cold or hot area, the vehicle is driven to climb up slopes, the vehicle is driven with the accelerator pedal being fully depressed such as in racing, or the vehicle is used for a long period of time. Namely, the ignition coil according to the embodiment has a high durability relative to a thermal environment.

In addition, according to the ignition coil of the embodiment, the radial width of the gap 9 is set at 0.15 mm. Due to this, the risk is diminished that the insulation distance between the primary coil and the secondary coil substantially becomes short.

(Second Embodiment)

The difference between a second embodiment and the first embodiment is that a primary spool is formed from an improved SPS. Consequently, only the difference will be described here.

Figure 4:
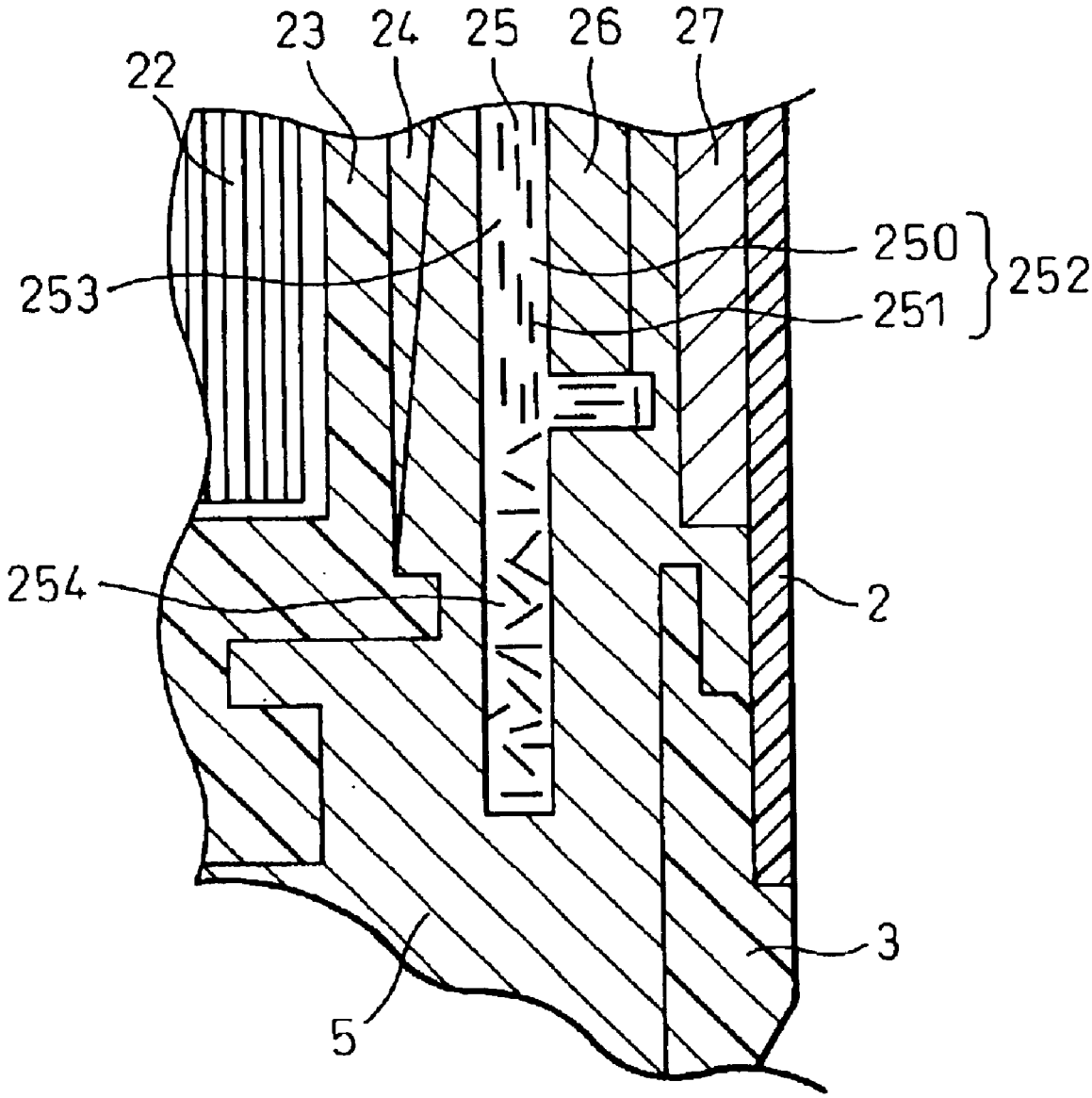
FIG. 4 is an enlarged sectional view showing a portion in the vicinity of an end portion of a primary spool of an ignition coil according to a second embodiment of the invention.

Firstly, the construction of the primary spool will be described. An enlarged sectional view is shown in FIG. 4 which shows a portion in the vicinity of an end portion (corresponding to the portion A in FIG. 1) of the primary spool of an ignition coil according to the second embodiment. Note that like reference numerals are given to members corresponding to those shown in FIG. 3. In addition, a rubber tube is omitted. As shown in the figure, the primary spool 25 is formed from an improved SPS 252 comprising an SPS 250 and glass fibers 251. The primary spool 25 comprises a winding portion 253 having a primary coil 26 on an outer circumferential surface thereof and end portions 254 which are disposed at axial ends of the winding portion 253.

As the primary spool 25 of the embodiment is also formed from the improved SPS 252, as with the primary spool of the first embodiment, the primary spool 25 easily separates from an resin insulation material 5. Consequently, the end portion 254 easily separates from the resin insulation material 5.

When the end portion 254 separates from the resin insulation material 5 the end portion 254 and the resin insulation material 5 are allowed to expand or contract independently relative to the same thermal load.

As this occurs, if the linear expansion coefficient of the end portion is in excess of 135% of the linear expansion coefficient of the resin insulation material 5, the amount of expansion or contraction of the end portion 254 becomes much larger than that of the resin insulation material 5. Due to this, if the end portion 254 deforms such that the diameter thereof decreases toward an inner circumferential side thereof (toward the left-hand side of FIG. 4), there may be incurred the risk that the end portion 254 and the resin insulation material 5 filled below and on the inner circumferential side of the end portion 254 are brought into press contact with each other. Then, this press contact force may cause a certain defect in the resin insulation material 5 and/or the primary spool 25.

However, the glass fibers 251 are dispersed at random in the end portion 254 of the primary spool 25 of the embodiment. The linear expansion coefficient of the end portion 254 can be reduced by the glass fibers 251 which are dispersed at random. Due to this, the linear expansion coefficient of the end portion 254 of the embodiment is substantially equal to that of epoxy resin making up the resin insulation material 5. Thus, the amounts of expansion or contraction of the end portion 254 and the resin insulation material 5 when subjected to the same thermal load are also substantially equal to each other. Consequently, according to the ignition coil of the embodiment, the risk is diminished that the end portion 254 and the resin insulation material 5 are brought into press contact with each other. Thus, the ignition coil according to the embodiment creates fewer defects and is highly reliable.

On the other hand, the glass fibers 251 are oriented in an axial direction in the winding portion 253 of the primary spool 25 of the embodiment. In the event that the glass fibers 251 are oriented in the axial direction, the linear expansion coefficient of the winding portion 253 is increased. Namely, the difference in linear expansion coefficient between the winding portion 253 and the resin insulation material 5 is increased. With the winding portion 253, however, only a gap is formed between the winding portion 253 and the resin insulation material 5 which surrounds the winding portion 253 when the winding portion 253 and the resin insulation material 5 expand or contract in diametrical directions, and even if such a gap is formed, as the SPS is used for the resin material, a high insulation breakdown voltage can be provided by the SPS and if there are any problem, the problem can be diminished.

Next, a method for fabricating the ignition coil of the embodiment will be described. Among the members constituting the ignition coil, the primary spool is fabricated by a method comprising a spool material preparing process, a spool member molding process and a gate cutting process.

In the spool material preparing process, glass fibers are added to a molten SPS resin (commercially available from Idemitsu Sekiyu Kagaku Co., Ltd. under the trade name of XAREC) for dispersion therein. Then, a spool material is prepared which becomes a raw material for the primary spool.

Figure 5:
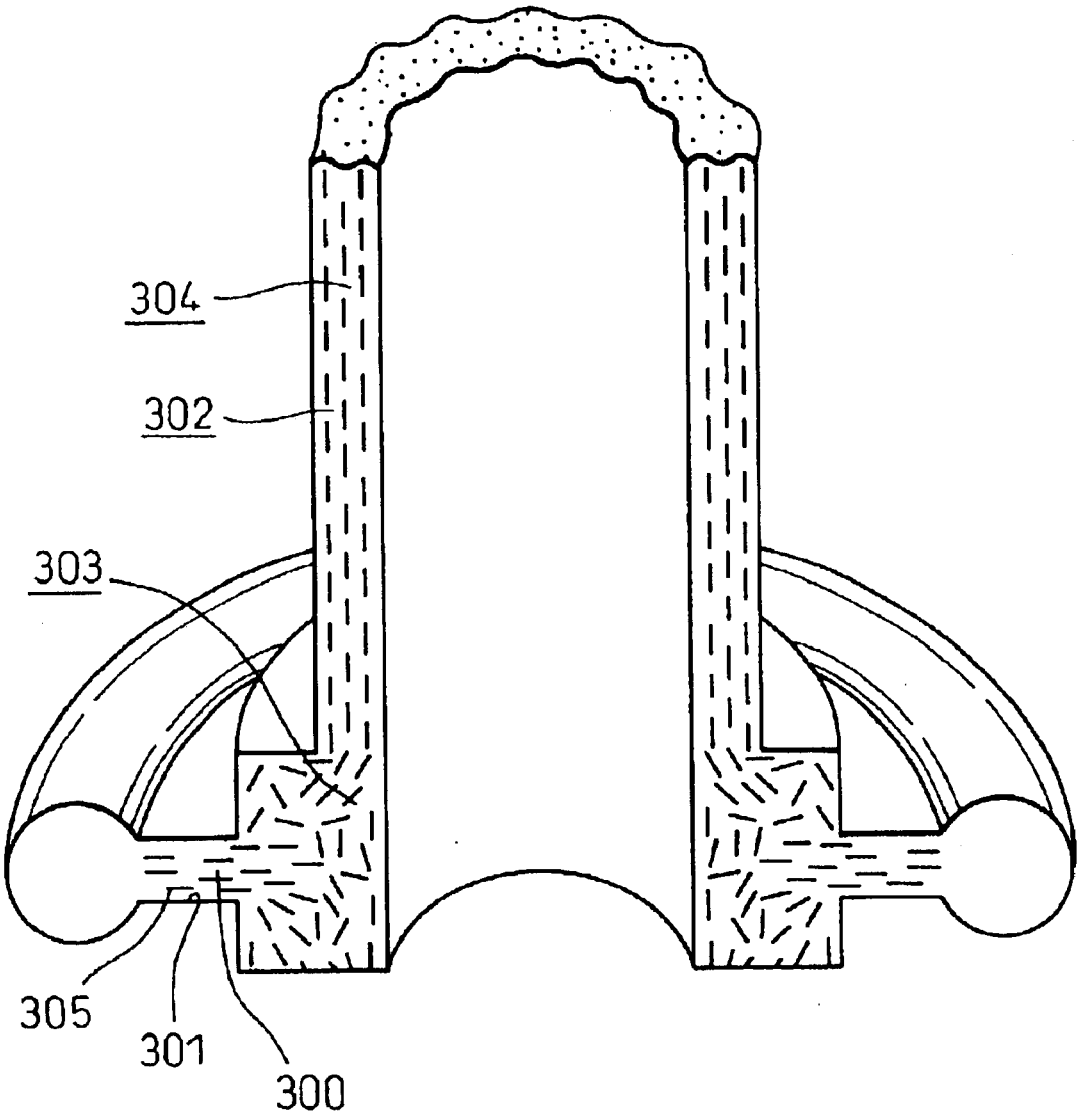
FIG. 5 is a perspective view of a portion in the vicinity of a cavity of a mold used in a spool member molding process of a method for fabricating the ignition coil according to the second embodiment.

In the spool member molding process, the spool member in which the glass fibers are oriented is molded. A perspective view is shown in FIG. 5 which shows a portion in the vicinity of a cavity of a mold used in this process. A cavity 302 comprises an end portion molding part 303 and a winding portion molding part 304. The end portion molding part 303 is set such that the diametrical width of the end portion molding part 303 becomes larger than that of the winding portion molding part 304. In addition, a ring gate 301 is provided circumferentially on an outer circumferential side of a portion corresponding to the end portion molding part 303 of the cavity 302.

A spool material 300 injected from a nozzle of an injection molding machine flows into the end portion molding part 303 in the cavity 302 from the ring gate 301. Namely, the spool material 300 flows in a direction in which the diameter is reduced. Here, a direction in which the cavity 302 extends is normal to the direction in which the spool material 300 flows in. In addition, the diametrical width of the end portion molding part 303 is larger than that of the winding portion molding part 304. Due to this, glass fibers 305 in the spool material 300 which has so flowed in are not oriented and dispersed at random at the end portion molding part 303.

The spool material 300 flowed in the end portion molding part 303 flows into the winding portion molding part 304. The diametrical width of the winding portion molding part 304 is smaller than that of the end portion molding part 303. In addition, the spool material 300 flows in along the longitudinal direction of the winding portion molding part 304. Due to this, glass fibers 305 in the spool material 300 which has so flowed in are oriented longitudinally of the winding portion molding part 304 at the same portion.

When the spool material 300 is filled in the cavity 302 the spool material 300 is then cooled so as to be set. Then, a spool member is obtained when the mold (not shown) is removed from the spool material so set. The glass fibers are disposed at random at end portions of the spool member. In addition, the glass fibers are oriented longitudinally at the winding portion of the spool member.

In the gate cutting process, a ring gate corresponding portion which connects to the end portion of the spool member is cut. Then, the surface of the end portion which is cut from the gate is finished with a grinder, or a flat file, as required.

The primary spool of the embodiment is prepared through the aforesaid processes. Thereafter, a primary coil is disposed on an outer circumferential surface of the winding portion of the primary spool, and the primary spool so provided with the primary coil is then combined with members such as a secondary spool which is fabricated through injection molding, a case and a high-voltage tower, whereby the ignition coil according to the embodiment is completed.

(Third Embodiment)

The difference between a third embodiment and the second is that glass fibers are oriented circumferentially at end portions of a primary spool. Consequently, only the difference will be described.

Figure 6:
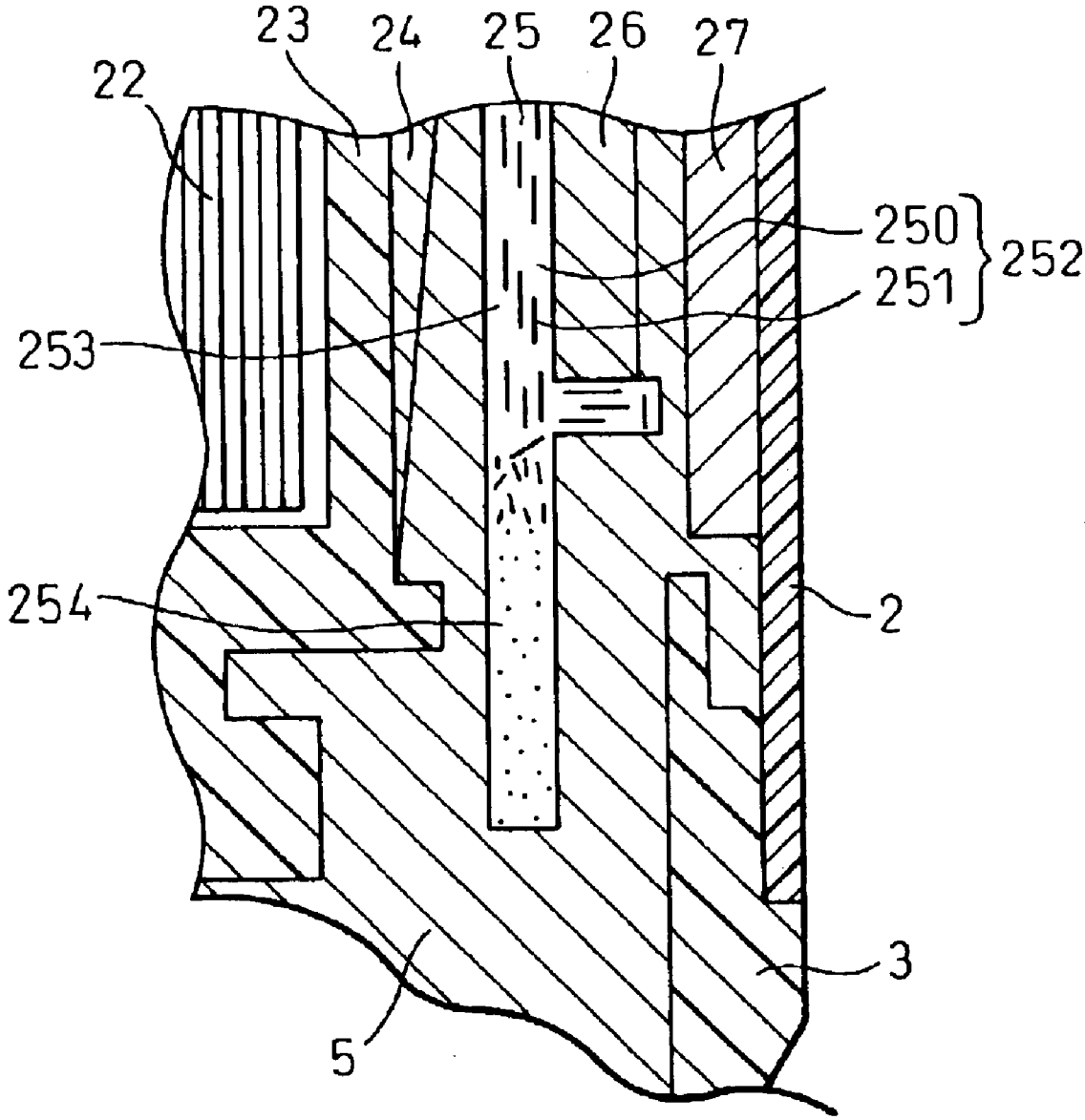
FIG. 6 is an enlarged view showing a portion in the vicinity of a primary spool of an ignition coil according to a third embodiment of the invention.

An enlarged sectional view is shown in FIG. 6 which shows a portion in the vicinity of an end portion (corresponding to the portion A in FIG. 1) of the primary spool of an ignition coil according to the third embodiment. Like reference numerals are given to members corresponding to those shown in FIG. 3. In addition, a rubber tube is omitted. As shown in the figure, glass fibers 251 are oriented circumferentially at the end portion 254 of the primary spool 25 of the embodiment. The linear expansion coefficient of the end portion 254 can be reduced when the glass fibers 251 are oriented circumferentially. The linear expansion coefficient of the end portion 254 of the embodiment is substantially equal to that of a resin insulation material 5. Due to this, the linear expansion coefficient of the end portion 254 of the embodiment is substantially equal to that of epoxy resin making up the resin insulation material 5. Thus, the amounts of expansion or contraction of the end portion 254 and the resin insulation material 5 when subjected to the same thermal load are also substantially equal to each other. Consequently, according to the ignition coil of the embodiment, the risk is diminished that the end portion 254 and the resin insulation material 5 are brought into press contact with each other. Thus, the ignition coils according to the embodiment have fewer defects and are highly reliable.

Next, a method for fabricating the ignition coil of the embodiment will be described. The difference between the fabricating method of this embodiment and that of the second embodiment is that a film gate is disposed at the end portion molding part of the cavity instead of the ring gate. Thus, here, only the difference will be described.

Figure 7:
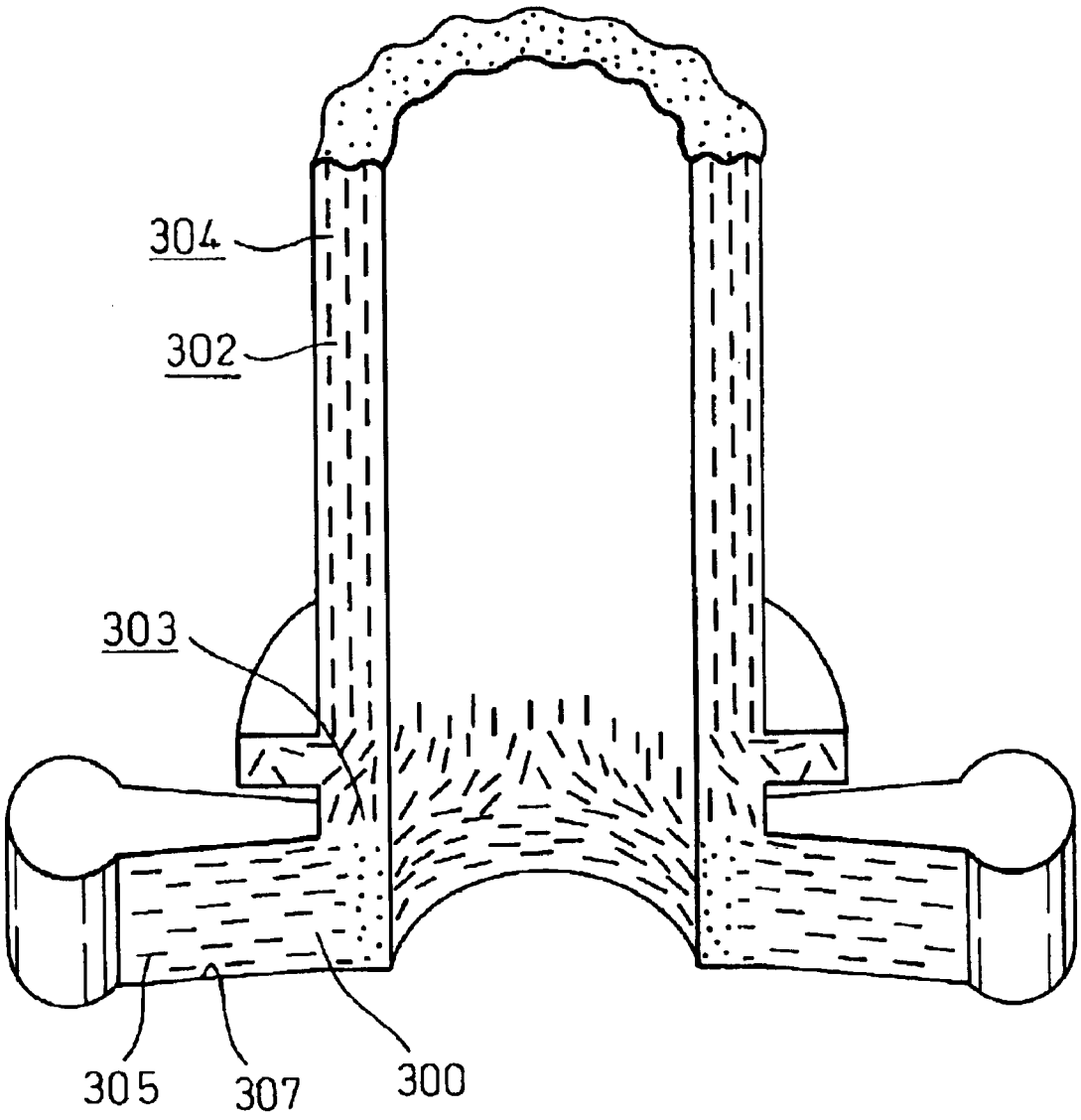
FIG. 7 is a perspective view showing a portion in the vicinity of a cavity of a mold used in a spool member molding process of a method for fabricating the ignition coil according to the third embodiment.

A perspective view is shown in FIG. 7 which shows a portion in the vicinity of a cavity of a mold used in a spool molding process of the embodiment. A cavity 302 comprises an end portion molding part 303 and a winding portion molding part 304. A film gate 307 is disposed on an outer circumferential side of a portion of the cavity 302 which corresponds to the end portion molding part 303 thereof.

A spool material 300 injected from a nozzle (not shown) of an injection molding machine flows into an end portion molding part in the cavity 302 from the film gate 307. As this occurs, the spool material 300 so injected flows circumferentially at the end portion molding part 303. Due to this, glass fibers 305 in the spool material 300 are oriented circumferentially at the end portion molding part 303.

The spool material 300 which has flowed into the end portion molding part 303 continues to flow into a winding portion molding part 304. As this occurs, the spool material 300 flows in along the longitudinal direction of the winding portion molding part 304. Due to this, the glass fibers 305 in the spool material 300 are oriented along the longitudinal direction of the winding portion molding part 304 at the same part.

When the spool material 300 is filled in the cavity 302 the spool material 300 so filled is then cooled so as to be set. Then, a spool member is obtained when the mold (not) shown is removed from the spool material so set. The glass fibers are oriented circumferentially at the end portions of the spool member so obtained. In addition, the glass fibers are oriented longitudinally at the winding portion of the spool member.

In the gate cutting process, a film gate corresponding portion which connects to the end portion of the spool member is cut. Then, the surface of the end portion which is cut from the gate is finished with a grinder or a flat file as required.

The primary spool of the embodiment is prepared through the aforesaid processes. Thereafter, a primary coil is disposed on an outer circumferential surface of the winding portion of the primary spool, and the primary spool so provided with the primary coil is then combined with members such as a secondary spool which is fabricated through injection molding, a case and a high-voltage tower, whereby the ignition coil according to the embodiment is completed.

(Other Embodiments)

Thus, while the embodiments of the ignition coil of the invention have been described heretofore, the mode for carrying out the invention is not limited to those embodiments. The invention can be carried out using various types of modified and/or improved embodiments that those skilled in the art can carry out.

For example, in the ignition coil 1 according to the embodiments described above, while the primary spool 25 is disposed outside and the secondary spool 23 is disposed inside, the secondary spool 23 may be disposed outside and the primary coil 25 may be disposed inside.

In addition, in the ignition coil 1 according to the first embodiment, while only the base resin of the primary spool 25 is made up by the SPS, the base resins for all the spools may be made up by the SPS. The base resins are not limited to the SPS. Any resin having both an adhesive strength which is less than that provided by PBT and an insulation breakdown voltage which exceeds that provided PPS can be used as the base resin.

Additionally, in the ignition coil according to the second and third embodiments, while the primary spool 25 disposed between the secondary coil 24 and the primary coil 26 or disposed on the outer circumferential side is formed from the improved SPS 252. The reason why the improved SPS is used here is because the peripheries of the end portions of the spool disposed on the outer circumferential side are surrounded by the resin insulation material, and a defect tends to be caused easily at, in particular, portions in the vicinity of the end portions due to the difference in linear expansion coefficient between the spool and the resin insulation material. However, the spool on the inner circumferential side (the secondary spool 23 in the second and third embodiments) may also be formed from the improved SPS 252. Forming the spool on the inner circumferential side from the improved SPS 252 can improve the reliability of the ignition coil.

Furthermore, in the ignition coil according to the second and third embodiments, the primary spool 25 is formed from the improved SPS 252 comprising the SPS 250 and the glass fibers 251. Then, the linear expansion coefficients of the end portion 254 and the winding portion 253 are adjusted by the orientation of the glass fibers 251. However, the linear expansion coefficients can be adjusted by controlling the density of the glass fibers at the end portion 254 and the winding portion 253. In addition, the composition of the improved SPS is not limited to that described in the embodiments and any composition may be used provided that the linear expansion coefficients can be adjusted. For example, carbon fibers may be used for the glass fibers 251. In addition, other additives may be added instead of those fiber materials.

Additionally, in order to orient the glass fibers, the ring gate is used in the fabricating method according to the second embodiment and the film gate is used in the fabricating method according to the third embodiment. The reason why those gates are used is because using the ring gate or the film gate can easily make the glass fibers be oriented at random or circumferentially at the end portions. However, there is no specific limitation on the types of gates provided that the glass fibers can be oriented. For example, a disk gate or a fan gate may be used.

Furthermore, a construction may be adopted in which a magnet having an opposite polarity to a direction of magnetic flux generated when excited by the coil is disposed at ends of the core 22 of the ignition coil according to the embodiments. According to this construction, a voltage generated on the secondary side can easily be increased to a high voltage.

In addition, the ignition coil according to the embodiments is a so-called stick-type ignition coil adapted to be installed in the plug hole. The ignition coil according to the invention can maintain a high electric insulation quality for a long time even under a severe thermal cycle environment. Additionally, according to the ignition coil of the invention, there is no need to wind a separation tape around the spool additionally in order to prevent the generation of cracks. Consequently, the outside diameter of the ignition coil can be reduced easily. Due to this, as has been described in the embodiments, the ignition coil of the invention is preferable in embodying a stick-type ignition coil which is required not only to bear severe temperature changes and but also to meet the demand for a reduction in outside diameter. However, the ignition coil of the invention may be embodied as other types of ignition coils.

Moreover, in the first embodiment, while the case is made to function as the outer core, in an ignition coil having no outer core, a resin case 2 may be used as the case. In this case, the case may be made from PET or PBT having a high adhesion to the resin insulation material, whereas the outer spool may be formed from PPS or SPS having a low adhesion to the resin insulation material.

EXAMPLE

Here, instead of the spool of the actual ignition coil, a plate-like test piece which uses SPS (commercially available from Idemitsu Sekiyu Kagaku Co., Ltd. under the trade name of XAREC) as the base resin was prepared as an example representing the invention, and the adhesive strength to the resin insulation material made from epoxy resin and insulation breakdown voltage of the example were measured. Additionally, plate-like test pieces, adopting as the base resin PPE, PBT, PET, PPS were prepared as Comparison Example 1, Comparison Example 2, Comparison Example 3 and Comparison Example 4, respectively, and the adhesive strength to the resin insulation material and insulation breakdown voltages thereof were also measured. Note that the example of the invention and the comparison examples were prepared through injection molding.

(Measuring Method)

Figure 8:
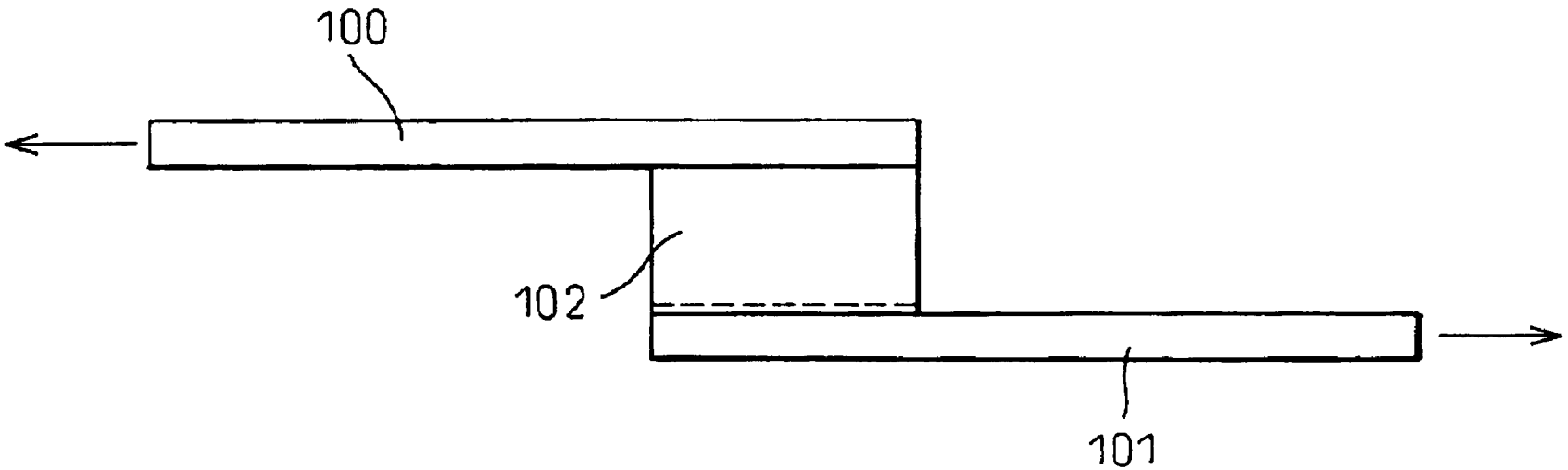
FIG. 8 is a diagram showing a method for measuring an adhesive strength to a resin insulation material.
Figure 9A:
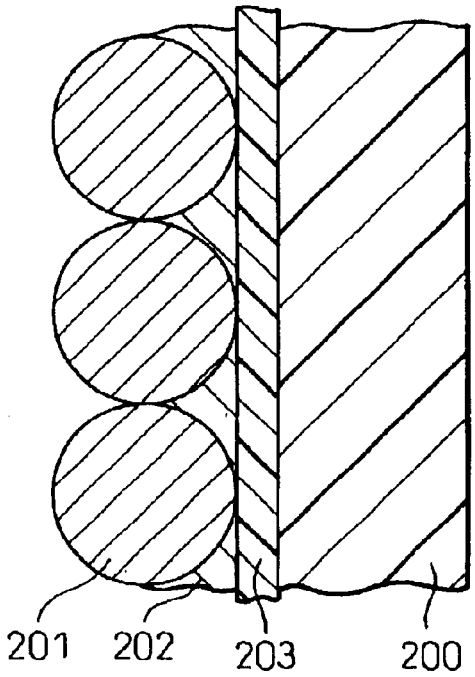
FIGS. 9A and 9B are axial enlarged sectional views showing portions in the vicinity of a spool of a conventional ignition coil, respectively.
Figure 9B:
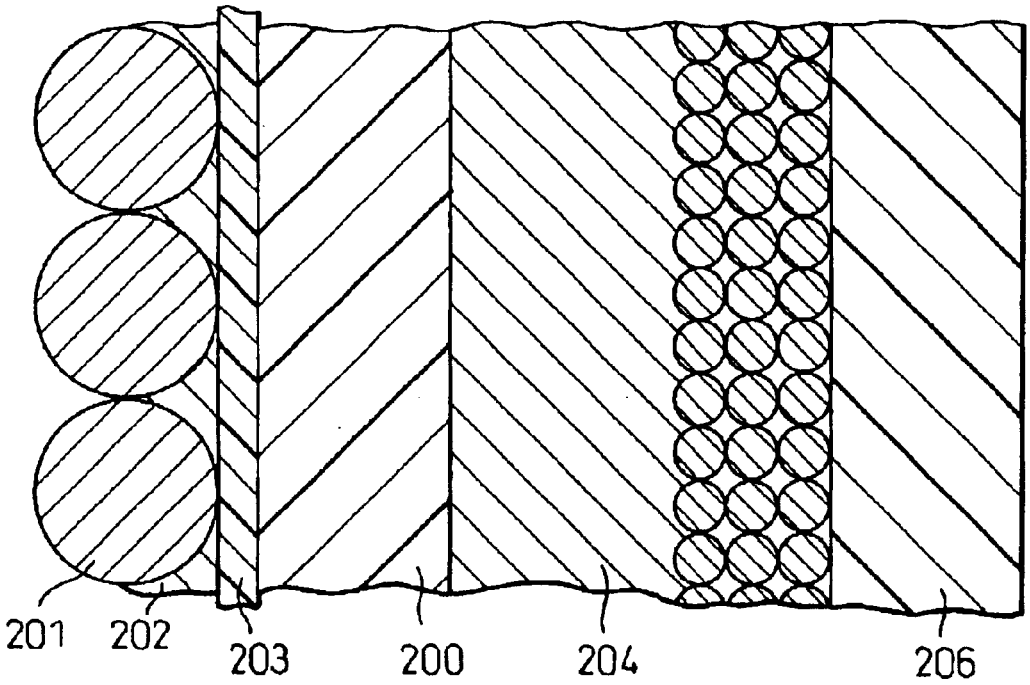
Figure 10:
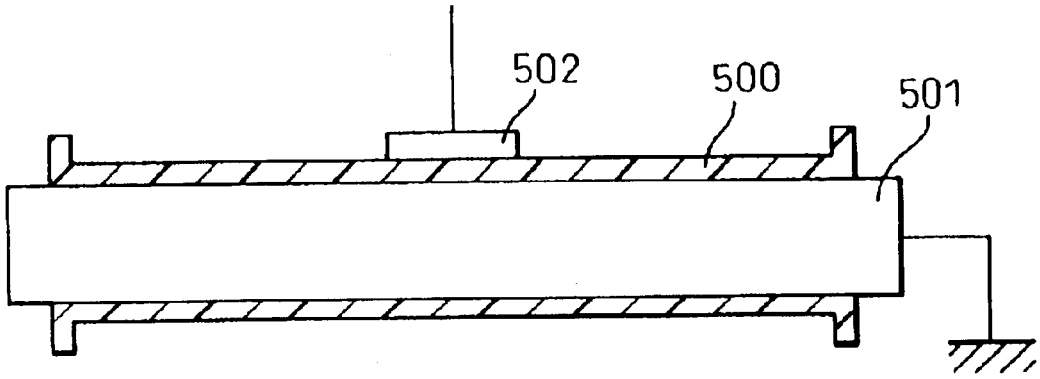
FIG. 10 is a conceptual diagram of an insulation breakdown voltage measuring method in which a spool itself is actually measured.

Firstly, a method for measuring the adhesive strength to the resin insulation material will be described. An adhesive strength measuring method is schematically shown in FIG. 8. In preparation for measurement, as shown in the figure, firstly, a test piece 100 and a test piece 101 are disposed such that the test pieces partially overlap each other on surfaces thereof. Note that the test piece 100 and the test piece 101 were made from the same resin. Next, the test piece 100 and the test piece 101 were bonded together at the overlapping portions thereof with a resin insulation material 102 made of epoxy resin. Then, the resin insulation material 102 was allowed to set in that condition.

The adhesive strength was measured by pulling the test piece 100 and the test piece 101 in directions in which the test pieces separate from each other as indicated by arrows shown in the figure. Then, a load with which either of the test pieces 100 and 101 separates from the resin insulation material 2 was measured. A value obtained by dividing the load so measured by the area over which either of the test pieces 100 and 101 and the resin insulation material 102 were allowed to adhere to each other was regarded as the adhesive strength.

The measurement of insulation breakdown voltage was carried out by gradually increasing the voltage applied to the test piece. Then, a minimum voltage at which the insulation of the sample was broken was measured. The minimum voltage so measured was regarded as the insulation breakdown voltage of the test piece.

(Results of Measurements)

The results of measurement of the adhesive strength to the resin insulation material and insulation breakdown voltages of the test piece of the invention and the comparison examples are shown in Table 1.

TABLE 1

| | Example of Invention | Comparison Example 1 | Comparison Example 2 | Comparison Example 3 | Comparison Example 4 |
|---|---|---|---|---|---|
| Base Resin | SPS | PPE | PBT | PET | PPS |
| Adhesion | x | ○ | Δ | Δ | x |
| Insulation Breakdown voltage | ○ | ○ | Δ | Δ | x |

○ ← high, Δ ← medium, x ← low

As shown in Table 1, it is found that the adhesive strength to the resin insulation material of the example of the invention is lower than those of the comparison examples 1 to 3. In addition, it is found that the adhesive strength of the example of the invention is equal to that of the comparison example 4.

Additionally, it is found that the insulation breakdown voltage of the example of the invention is higher than those of the comparison examples 2 to 4. Furthermore, it is found that the insulation breakdown voltage of the example of the invention is equal to that of the comparison example 1.

According to the invention, there can be provided the ignition coil that has a high electric insulation quality and which provides a low production cost.

Note that while the invention has been described in detail based upon the specific embodiments, it is obvious that those skilled in the art can change and modify the invention variously without departing from the spirit and scope of the invention.

What is claimed is:

1. An ignition coil having a case, a rod-like core installed in said case, a cylindrical primary spool disposed substantially coaxially around an outer circumference of said core within said case, a primary coil comprising a wire wound around said primary spool, a cylindrical secondary spool disposed substantially coaxially around the outer circumference of said core within said case, a secondary coil comprising a wire wound around said secondary spool and a resin insulating material filled within said case, said ignition coil being characterized in that;

the spool of said primary and said secondary spools which is disposed between said secondary coil and said core and/or which is disposed between said secondary coil and said primary coil comprises a base resin having an adhesive strength to said resin insulating material which is less than that provided by polybutylene terephthalate and an insulation breakdown voltage which exceeds that provided by polyphenylene sulfide.

2. The ignition coil as set forth in claim 1, wherein said base resin is a syndiotactic polystyrene.

3. The ignition coil as set forth in claim 1, wherein said ignition coil is installed in a plug hole in a cylinder.

4. The ignition coil as set forth in claim 2, wherein said syndiotactic polystyrene is an improved syndiotactic polystyrene whose coefficient of linear expansion can be adjusted, and wherein the coefficient of linear expansion of an end portion of the spool comprising said improved syndiotactic polystyrene is 135% or less, assuming that the coefficient of linear expansion of said resin insulating material is 100%.

5. The ignition coil as set forth in claim 4, wherein said improved syndiotactic polystyrene is formed by adding reinforced fibers into a syndiotactic polystyrene, and wherein said reinforced fibers are oriented at random or circumferentially at said end portion of said spool.

6. The ignition coil as set forth in claim 5, wherein said reinforced fibers are glass fibers and said resin insulating material is an epoxy resin.

7. An ignition coil having a case, a rod-like core installed in said case, a cylindrical primary spool disposed substantially coaxially around an outer circumference of said core within said case, a primary coil comprising a wire wound around said primary spool, a cylindrical secondary spool disposed substantially coaxially around the outer circumference of said core within said case, a secondary coil comprising a wire wound around said secondary spool and a resin insulating material filled within said case, said ignition coil being characterized in that;

the spool of said primary and said secondary spools which is disposed between said secondary coil and said core and/or which is disposed between said secondary coil and said primary coil comprises a base resin having an adhesive strength to said resin insulating material which is less than that provided by polyethylene terephthalate and an insulation breakdown voltage which exceeds that provided by polyphenylene sulfide.

8. The ignition coil as set forth in claim 7, wherein said base resin is a syndiotactic polystyrene.

9. The ignition coil as set forth in claim 7, wherein said ignition coil is installed in a plug hole in a cylinder.

10. The ignition coil as set forth in claim 8, wherein said syndiotactic polystyrene is an improved syndiotactic polystyrene whose coefficient of linear expansion can be adjusted, and wherein the coefficient of linear expansion of an end portion of the spool comprising said improved syndiotactic polystyrene is 135% or less, assuming that the coefficient of linear expansion of said resin insulating material is 100%.

11. The ignition coil as set forth in claim 10, wherein said improved syndiotactic polystyrene is formed by adding reinforced fibers into a syndiotactic polystyrene, and wherein said reinforced fibers are oriented at random or circumferentially at said end portion of said spool.

12. The ignition coil as set forth in claim 11, wherein said reinforced fibers are glass fibers and said resin insulating material is an epoxy resin.

13. An ignition coil having a case, a rod-like core installed in said case, a cylindrical primary spool disposed substantially coaxially around an outer circumference of said core within said case, a primary coil comprising a wire wound around said primary spool, a cylindrical secondary spool disposed substantially coaxially around the outer circumference of said core within said case, a secondary coil comprising a wire wound around said secondary spool and a resin insulating material filled within said case, said ignition coil being characterized in that;

the spool of said primary and said secondary spools which is disposed between said secondary coil and said core and/or which is disposed between said secondary coil and said primary coil comprises a base resin which can hold an electric non-conductance even if a high voltage is produced in said secondary coil in association with the generation of a separation between said resin insulating material and said spool.

14. An ignition coil having a case, a rod-like core installed in said case, a cylindrical primary spool disposed substantially coaxially around an outer circumference of said core within said case and having a winding portion around which a winding is wound, a cylindrical secondary spool disposed substantially coaxially around the outer circumference of said core within said case and having a winding portion around which a winding is wound, and a resin insulating material filled and set within said case, said ignition coil being characterized in that;

at least one of said primary and secondary spools is an SPS spool comprising a syndiotactic polystyrene as a base resin.

15. The ignition coil as set forth in claim 14, wherein said primary spool is said SPS spool.

16. The ignition coil as set forth in claim 14, wherein the adhesion of said base resin to said resin insulating material is less than 15 MPa.

17. The ignition coil as set forth in claim 14, wherein a gap is formed between said winding portion of said SPS spool and said resin insulating material that has penetrated and set between turns of said winding wound around said winding portion, and wherein said gap is formed in such a manner as to extend over 70% or more of the surface area of said winding portion.

18. The ignition coil as set forth in claim 17, wherein said gap is formed in such a manner as to extend over 90% or more of the surface area of said winding portion.

19. The ignition coil as set forth in claim 14, wherein a gap is formed between said winding portion of said SPS spool and said resin insulating material that has penetrated and set between turns of said winding wound around said winding portion, and wherein the radial width of said gap is 0.01 mm or greater.

20. The ignition coil as set forth in claim 19, wherein the radial width of said gap is less than 0.3 mm.

21. The ignition coil as set forth in claim 19, wherein said gap is formed in such a manner as to extend over 70% or more of the surface area of said winding portion.

22. The ignition coil as set forth in claim 19, wherein said gap is formed in such a manner as to extend over 90% or more of the surface area of said winding portion.

23. The ignition coil as set forth in claim 14, wherein the insulation breakdown voltage of said base resin is 15 kV/mm or greater when measured using a measuring method of JIS K 6911.

24. The ignition coil as set forth in claim 14, wherein said case is formed of a high-adhesion resin having a higher adhesion to said resin insulating material than to said base resin.

25. An ignition coil having a case, a rod-like core installed in said case, a cylindrical primary spool disposed substantially coaxially around an outer circumference of said core within said case and having a winding portion around which a winding is wound, a cylindrical secondary spool disposed substantially coaxially around the outer circumference of said core within said case and having a winding portion around which a winding is wound, and a resin insulating material filled and set within said case, said ignition coil being characterized in that;

a gap is formed between said winding portion possessed by at least one of said primary and secondary spools and said resin insulating material that has penetrated and set between turns of said winding wound around said winding portion after said resin insulating material has set.

26. The ignition coil as set forth in claim 25, wherein the spool situated adjacent to said gap is said primary spool.

27. The ignition coil as set forth in claim 25, wherein a base resin composing the spool situated adjacent to said gap is a syndiotactic polystyrene.

28. The ignition coil as set forth in claim 25, wherein said gap is formed in such a manner as to extend over 70% or more of the surface area of said winding portion.

29. The ignition coil as set forth in claim 28, wherein said gap is formed in such a manner as to extend over 90% or more of the surface area of said winding portion.

30. The ignition coil as set forth in claim 28, wherein the radial width of said gap is 0.01 mm or greater.

31. The ignition coil as set forth in claim 30, wherein the radial width of said gap is less than 0.3 mm.

32. The ignition coil as set forth in claim 30, wherein said gap is formed in such a manner as to extend over 70% or more of the surface area of said winding portion.

33. The ignition coil as set forth in claim 30, wherein said gap is formed in such a manner as to extend over 90% or more of the surface area of said winding portion.

34. The ignition coil as set forth in claim 25, wherein the insulation breakdown voltage of said base resin composing the spool situated adjacent to said gap is 15 kV/mm or greater when measured using a measuring method of JIS K 6911.

35. The ignition coil as set forth in claim 25, wherein the insulation breakdown voltage of said base resin composing the spool situated adjacent to said gap is 15 kV/mm or greater when measured using a measuring method for actually measuring said spool itself.

36. The ignition coil as set forth in claim 25, wherein the adhesive strength of said base resin composing the spool situated adjacent to said gap to said resin insulating material is less than 15 MPa.

37. A method for fabricating an ignition coil having a spool comprising a winding portion around which a wire is wound and end portions disposed at longitudinal ends of said winding portion, said method comprising:

a spool material preparing process for preparing a spool material by adding reinforced fibers into a molten resin;

a spool member molding process for injecting said spool material into a cavity in a mold from a gate disposed at a position which confronts an end portion molding part of said cavity, cooling said spool material so injected so that said spool material sets in said cavity, and molding a spool member in which said reinforced fibers are oriented at random or circumferentially at said end portions; and a gate cutting process for cutting a portion of said spool member which corresponds to said gate.

38. The method for fabricating an ignition coil as set forth in claim 37, wherein said gate is a ring gate or a film gate.

39. A method for fabricating an ignition coil having a case, a rod-like core disposed in said case, a cylindrical inner spool disposed substantially coaxially around an outer circumference of said core within said case and having a winding portion around which a winding is wound, a cylindrical outer spool disposed substantially coaxially around the outer circumference of said core within said case, possessing a winding portion around which a winding is wound and having an outer circumferential surface having a lower adhesion to a resin insulating material than to an inner circumferential surface of said case, and said resin insulating material filled and set within said case, said method comprising:

an insulating material filling process for filling said resin which is something like a liquid into said case in which said respective members are disposed;

an insulating material gelling process for gelling said resin insulating material so filled at a high temperature; and an insulating material cooling process for cooling said resin insulating material so gelled together with said case and said outer spool.

* * * * *